US011964194B2

(12) United States Patent
Dev

(10) Patent No.: US 11,964,194 B2
(45) Date of Patent: Apr. 23, 2024

(54) CUSTOMIZABLE TRAINING BAT

(71) Applicant: Rishaan R. Dev, Bartlett, IL (US)

(72) Inventor: Rishaan R. Dev, Bartlett, IL (US)

( * ) Notice: Subject to any disclaimer, the term of this patent is extended or adjusted under 35 U.S.C. 154(b) by 0 days.

(21) Appl. No.: 17/739,160

(22) Filed: May 9, 2022

(65) Prior Publication Data

US 2022/0355171 A1 Nov. 10, 2022

Related U.S. Application Data

(60) Provisional application No. 63/186,132, filed on May 9, 2021.

(51) Int. Cl.

| | |
|---|---|
| ***A63B 69/00*** | (2006.01) |
| ***A63B 60/00*** | (2015.01) |
| ***A63B 60/16*** | (2015.01) |
| *A63B 102/18* | (2015.01) |

(52) U.S. Cl.

CPC ..... *A63B 60/0085* (2020.08); *A63B 60/16* (2015.10); *A63B 69/0002* (2013.01); *A63B 69/0015* (2013.01); *A63B 2069/0008* (2013.01); *A63B 2102/18* (2015.10); *A63B 2102/182* (2015.10)

(58) Field of Classification Search

CPC . A63B 60/0085; A63B 60/16; A63B 69/0002; A63B 69/0015; A63B 2069/0008; A63B 2102/18; A63B 2102/182

USPC ..... 473/222, 453, 457, 519, 520, 564–568

See application file for complete search history.

(56) References Cited

U.S. PATENT DOCUMENTS

| | | | | |
|---|---|---|---|---|
| 64,081 | A * | 4/1867 | Dibble | |
| 1,499,128 | A * | 6/1924 | Shroyer, Jr. | A63B 59/50 473/566 |
| 3,414,260 | A * | 12/1968 | Gust | A63B 69/38 482/109 |
| 4,819,935 | A * | 4/1989 | Dirksing | A63B 69/38 482/109 |
| 6,569,042 | B2 * | 5/2003 | LaChance | A63B 69/0002 473/519 |
| 6,682,447 | B1 * | 1/2004 | Black | A63B 15/00 473/519 |
| 6,939,237 | B1 * | 9/2005 | Voden | A63D 15/08 473/44 |
| 7,140,988 | B1 * | 11/2006 | Hinman | A63B 59/51 473/566 |

(Continued)

*Primary Examiner* — Nini F Legesse

(74) *Attorney, Agent, or Firm* — Helix Patent Services LLC

(57) ABSTRACT

A customizable training bat includes a handle on a proximal end and an endcap on a distal end. Several body segments used for hitting extend between the handle and the endcap from the proximal end to the distal end over an extendable support rod passing through each of the body segments. To prevent relative shifting and movement between handle and body segments or between adjacent body segments, handle and body segments may contain mechanisms for interlocking. An optional hollow casing encloses the body segments and is connected to the handle in a way that allows it to be extended. The handle also optionally has a detachable knob of variable weight. The length of the bat is varied by adding or removing the body segments and adjusting length of support rod extending from the handle. The bat's size, shape and swing weight can be modified by using the desired body segments.

19 Claims, 16 Drawing Sheets

(56) References Cited

U.S. PATENT DOCUMENTS

| | | | | |
|---|---|---|---|---|
| 8,282,510 | B1 | 10/2012 | Englund | |
| 8,827,846 | B2 * | 9/2014 | Shocklee | A63B 60/10 473/453 |
| 9,943,740 | B2 | 4/2018 | Mayers, III et al. | |
| 10,155,147 | B1 | 12/2018 | Yablonowski et al. | |
| 10,166,428 | B2 * | 1/2019 | Giafardino | A63B 21/072 |
| 11,185,749 | B2 * | 11/2021 | Wiese | A63B 59/56 |
| 2004/0063520 | A1 | 4/2004 | Mabry | |
| 2015/0224381 | A1 | 8/2015 | Rodriguez | |
| 2015/0273302 | A1 | 10/2015 | Brownstein et al. | |
| 2019/0022490 | A9 | 1/2019 | Umbrell | |
| 2019/0262684 | A1 | 8/2019 | Perry | |

* cited by examiner

CUSTOMIZABLE TRAINING BAT

This application claims priority to provisional patent application Ser. No. 63/186,132, filed May 9, 2021, to the extent allowed by law.

TECHNICAL FIELD

The present subject matter is, in general, related to a training bat and particularly, but not exclusively, to a customizable training bat whose swing weight, length and shape can be customized to the needs of an athlete.

BACKGROUND

Training bats are generally used in sports like Baseball, Softball and Cricket to target improving specific skills of athletes such as hand-eye coordination of the athlete, swing mechanics and swing/bat speed. Training bats that target improving the hand-eye coordination of an athlete typically use shape profiles that make it harder for the hitter to achieve the contact with the ball and thereby encourage the athlete to watch the ball closely. For example, these bats come with a narrow thickness or short length. Thickness can mean diameter of the hitting surface for baseball and softball bats or width and depth of the cricket bat.

Similarly, training bats that target improving swing mechanics of an athlete work by encouraging the athlete to move his/her hands, arms and torso in a certain way through a specific weight distribution on the bat, thereby making it harder to swing the bat in an incorrect way. Also, swing training technique holding bat on one hand is targeted to improve the arm path and alignment of the hands throughout the swing path. This requires usage of a tiny bat and is commonly used by athletes of all age and skill levels.

Further, in the existing scenario, the commonly used technique to increase the swing speed involves practicing the swing with heavier and lighter bats in alternating sequences. The usage of the heavier bats also promotes muscle strengthening and warm up. So, these bats are also utilized by the hitters to do swings before they go out to do the hitting in an actual game.

However, most of these training tools have a unique and specific purpose and target improving a particular skill of an athlete. So, in order to enhance overall skills, an athlete must acquire multiple training bats in the course of their development, which is an expensive and inconvenient option to the athlete. Also, the existing training tools are designed for athletes of specific age groups as they come in specific length and weight. Consequently, as the young athletes get older, they outgrow the training tools and need to acquire more of those in larger length and weight.

In view of the above limitations in the existing training bats, it would be advantageous to have a training bat that can be customized to the needs of athletes, irrespective of the skills and age group of the athlete.

The information disclosed in this background of the disclosure section is only for enhancement of understanding of the general background of the invention and should not be taken as an acknowledgement or any form of suggestion that this information forms the prior art already known to a person skilled in the art.

SUMMARY

It is an objective of the present invention to mitigate, alleviate or eliminate one or more of the above-identified deficiencies and disadvantages in the existing solutions and solve at least the above-mentioned problems.

In view of the foregoing, an embodiment of the present disclosure relates to a fully customizable training bat for baseball, softball, cricket or any other similar sport, whose swing weight and size and shape can be adjusted as per requirements and preferences of the athlete, without using a variety of training tools and risk of outgrowing. The proposed training bat consists of removable and replaceable building blocks that allow quick construction and reshaping of the bat by using varying length, shape and weight distributions across the length of the training bat for improving multiple skills of the athlete.

In an embodiment of the present disclosure, the customizable training bat comprises a proximal end and a distal end, such that plurality of body segments extend from the proximal end to the distal end of the customizable training bat. Further, an extendable support rod having a proximal end and a distal end is passed through each of the plurality of body segments. A handle having an opening accommodates the extendable support rod and a removably connected endcap provides a closure to the extendable support rod.

In an embodiment, the plurality of body segments may be designed with varying size, shape and weight and are secured between the handle and the endcap. In an embodiment, the support rod can be turned by attaching the endcap to the distal end to elongate its exposed portion. The length of the bat can be adjusted by securing the handle and turning the endcap, that is latched onto the support rod, to elongate the exposed portion of the rod in order to allow the additional body segments to fit in or by using different sized support rods. By turning the handle, all body segments would turn due to interlocking extrusions.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE DRAWINGS

The accompanying drawings, which are incorporated in and constitute a part of this disclosure, illustrate exemplary embodiments and, together with the description, explain the disclosed principles. In the figures, the left-most digit(s) of a reference number identifies the figure in which the reference number first appears. The same numbers are used throughout the figures to reference like features and components. Some embodiments of system and/or methods in accordance with embodiments of the present subject matter are now described, by way of example only, and regarding the accompanying figures, in which.

Figure 1:
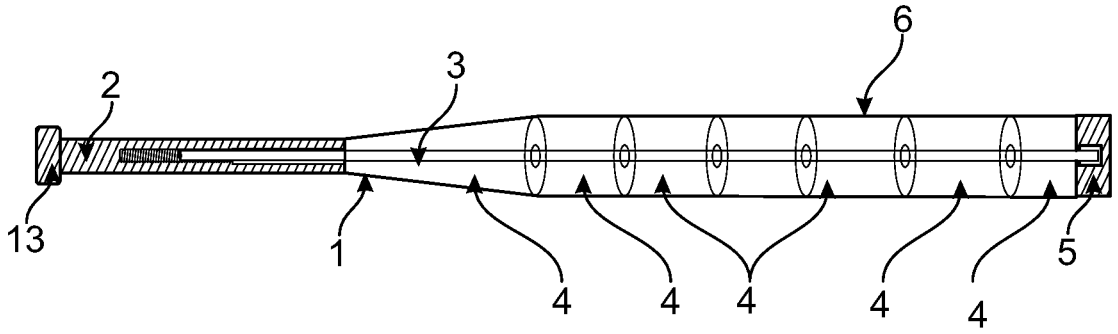
FIG. 1 shows an overview of the customizable training bat in accordance with some embodiments of the present disclosure.

It should be appreciated by those skilled in the art that any block diagrams herein represent conceptual views of illustrative systems embodying the principles of the present subject matter.

DETAILED DESCRIPTION

In the present document, the word "exemplary" is used herein to mean "serving as an example, instance, or illustration." Any embodiment or implementation of the present subject matter described herein as "exemplary" is not necessarily to be construed as preferred or advantageous over other embodiments.

While the disclosure is susceptible to various modifications and alternative forms, specific embodiment thereof has been shown by way of example in the drawings and will be described in detail below. It should be understood, however that it is not intended to limit the disclosure to the specific forms disclosed, but on the contrary, the disclosure is to cover all modifications, equivalents, and alternative falling within the scope of the disclosure.

The terms "comprises", "comprising", "includes", or any other variations thereof, are intended to cover a non-exclusive inclusion, such that a setup, device, or method that comprises a list of components or steps does not include only those components or steps but may include other components or steps not expressly listed or inherent to such setup or device or method. In other words, one or more elements in a system or apparatus proceeded by "comprises . . . a" does not, without more constraints, preclude the existence of other elements or additional elements in the system or method.

In the following detailed description of the embodiments of the disclosure, reference is made to the accompanying drawings that form a part hereof, and in which are shown by way of illustration specific embodiments in which the disclosure may be practiced. These embodiments are described in sufficient detail to enable those skilled in the art to practice the disclosure, and it is to be understood that other embodiments may be utilized and that changes may be made without departing from the scope of the present disclosure. The following description is, therefore, not to be taken in a limiting sense.

FIG. 1 shows an overview of the customizable training bat 1 in accordance with some embodiments of the present disclosure. As shown in FIG. 1, the customizable training bat 1 comprises a handle 2 (i.e., the proximal end of the bat) and an end cap 5 (i.e., the distal end of the bat). Further, the customizable training bat 1 (alternatively referred as 'bat 1' throughout the disclosure) comprises a plurality of body segments 4 that extend from the handle 2 to the end cap 5. In an embodiment, the plurality of body segments 4 may be attached and/or connected using a predefined interlocking mechanism. In an embodiment, the customizable training bat 1 further comprises an extendable support rod 3, such that the extendable support rod 3 passes through each of the plurality of body segments 4 in the customizable training bat 1. In an embodiment, the handle 2 of the customizable training bat 1 comprises an opening for accommodating the support rod 3. Also, at the distal end of the customizable training bat 1, the support rod 3 is covered by the removably connected endcap 5.

In an embodiment, the customizable training bat 1 may be covered and/or enclosed within a casing 6 for providing a smooth hitting surface for the customizable training bat 1. Also, the casing 6 provides added strength to the bat 1 and protection for encompassed body segments 4. As an example, the casing 6 may be made of at least one of wood, metal or a synthetic material. In an embodiment, depending on the material used for the casing 6, the support rod 3 may not be needed, as the casing 6 itself provides enough strength to the training bat 1. The casing 6 may be threaded on its proximal end 24 and distal end 25 so as to screw it onto the handle 2 and the end cap 5 of the training bat 1.

Figure 2:
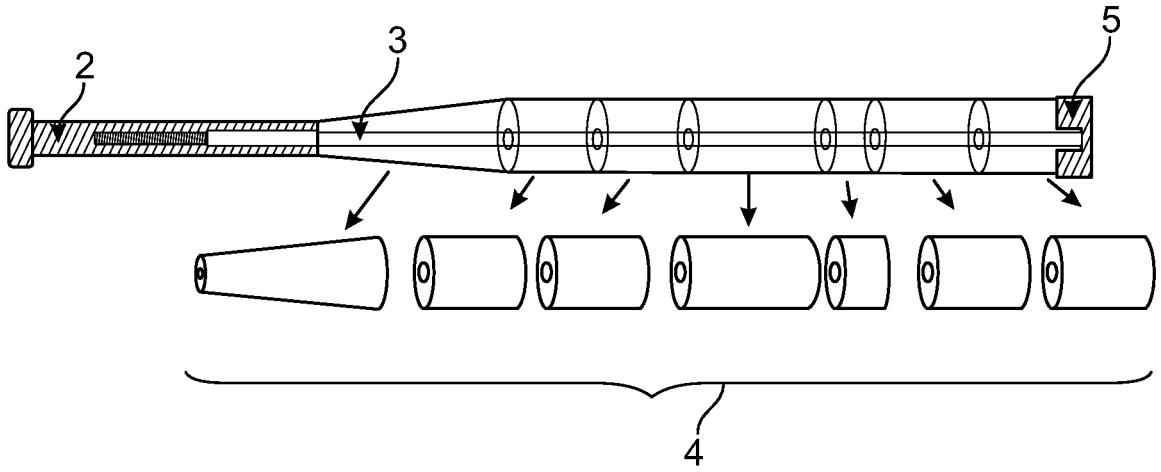
FIG. 2 illustrates arrangement of a plurality of body segments in the training bat in accordance with some embodiments of the present disclosure.

FIG. 2 illustrates arrangement of a plurality of body segments 4 in the training bat 1 in accordance with some embodiments of the present disclosure. In an embodiment, the plurality of body segments 4 forms the surface of the customizable training bat 1 which is meant for hitting. The plurality of body segments 4 can be compartmentalized into different segments with optional weight variations. Also, the plurality of body segments 4 may be color-coded for easily identifying the weight by their colors. As an example, the heaviest body segment 4 may be colored 'Red', while the lightest body segments 4 may be colored 'Grey'. In an embodiment, the plurality of body segments 4 can be of different lengths and shapes as well, thereby allowing further customization of the training bat 1 in terms of its length and shape.

Figure 3A:
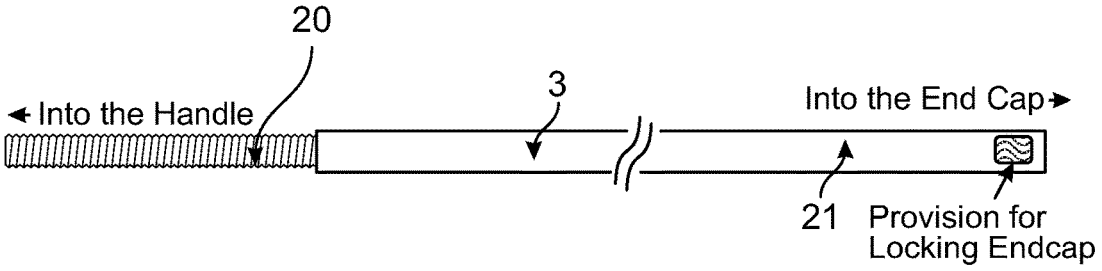
FIGS. 3*a*-3*c* illustrate exemplary embodiments of attaching a support rod to the handle and the end cap of the training bat in accordance with some embodiments of the present disclosure.
Figure 3B:
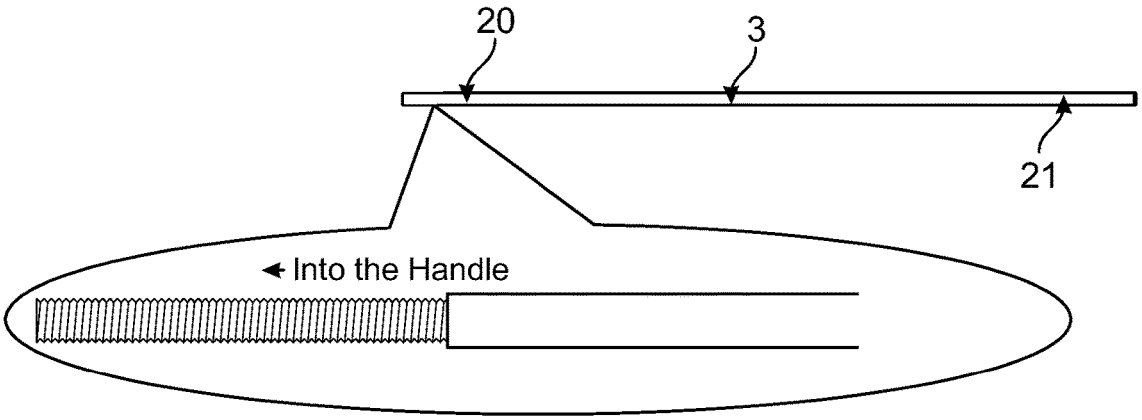
Figure 3C:
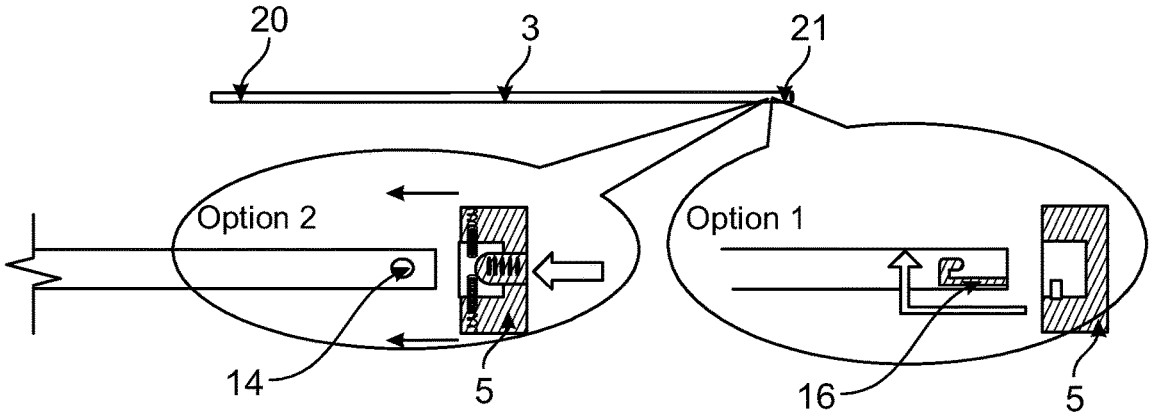

FIGS. 3*a*-3*c* illustrate exemplary embodiments of attaching a support rod 3 to the handle 2 and the end cap 5 of the training bat 1 in accordance with some embodiments of the present disclosure. In an embodiment, the support rod 3 holds the body of the training bat 1 by running through each of the plurality of body segments 4. The proximal end 20 of the support rod 3 may be screwed into the handle 2 portion of the training bat 1 and the distal end 21 of the support rod 3 allows the end cap to attach. Further, by turning the endcap 5 in specific directions, the support rod 3 can be tightened and/or loosened. When the endcap 5 is tightened, the support rod 3 attaches to the handle 2, such that each of the plurality of body segments 4 get tightly secured. In an embodiment, the support rod 3 is made of a sturdy, but light weight material, such as a hollow/solid tube made of a strong alloy material, such as zinc-plated steel or galvanized steel. This is to ensure that the own weight of the support rod 3 will not count for most of the weight of the training bat 1 and yet it should not bend when the training bat 1 is swung or hit by the ball.

In an embodiment, as shown in FIG. 3*a*, the distal end 21 of the support rod 3 may be connect to the endcap 5 and threaded on the proximal end 20 to thread into the handle 2. The threaded opening on the handle 2 allows the support rod 3 to screw inside the handle 2. The threaded portions may be used for adjusting and/or varying the length of the training bat 1. That is, the extent of rod that is screwed into the handle 2 would determine the length of the bat 1 and can be adjusted based on the needs of athlete. In an alternative embodiment, instead of threading, the support rod 3 may be provided with a locking provision to lock on to the handle 2 and the endcap 5. FIG. 3*b* shows a proximal end 20 of the support rod 3, which is threaded to go into the handle 2. The threading on the proximal end 20 may be used to screw the support rod 3 into the handle 2 or away from the handle 2, and thereby adjust the length of the training bat 1. FIG. 3*c* shows the distal end 21 of the support rod 3, which has a mechanism to allow the endcap 5 to attach itself to the support rod 3 and allows turning of the support rod 3. In an exemplary embodiment, the end cap 5 may be attached to the support rod 3 using one or more pins/dowel extrusions which could slide into a cutout/groove 16 on the distal end 21 of the support rod 3 (indicated as option 1 on FIG. 3*c*). In another exemplary embodiment, the endcap 5 may be attached to the support rod 3 using one or more spring-loaded pins provided within the endcap 5, which align and lock into pin holes 14 on the distal end 21 of the support rod 3 (indicated as option 2 on FIG. 3*c*). In an exemplary embodiment, the endcap 5 may be attached to the support rod 3 using one or more pins/dowel extrusions which could slide into a cutout/groove structure on the distal end 21 of the support rod 3 (indicated as option 1 on FIG. 3*c*). In another exemplary embodiment, the endcap 5 may be attached to the support rod 3 using one or more spring-loaded pins within the endcap 5, which align and lock into the groove on the distal end 21 of the support rod 3 (indicated as option 2 on FIG. 3*c*).

Figure 4:
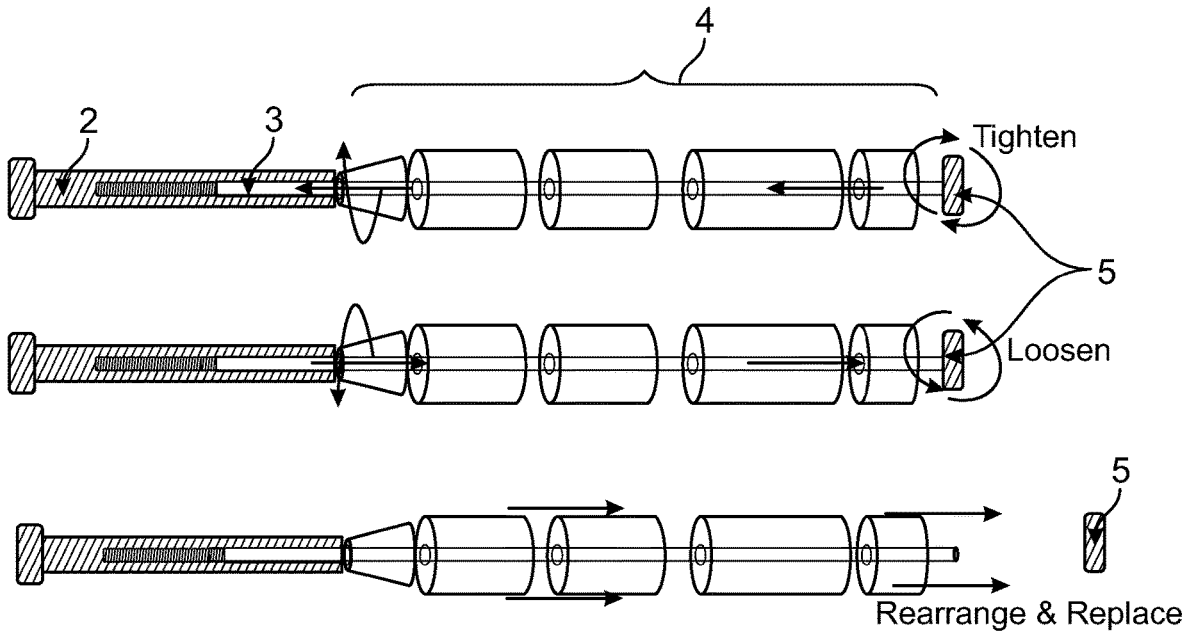
FIG. 4 provides an exemplary illustration of functioning of the endcap in accordance with some embodiments of the present disclosure.

FIG. 4 provides an exemplary illustration of functioning of the endcap 5 in accordance with some embodiments of the present disclosure. In an embodiment, the endcap 5 may attach to the distal end 21 of the support rod 3 and hold the plurality of body segments 4 tightly in place. The endcap 5 locks in place at the distal 21 end of the support rod 3 such that, when it is turned, the support rod 3 turns as well. The endcap 5 can be detached from the support rod 3 so that the body segments 4 can be removed, replaced and/or rearranged on to the support rod 3. The endcap 5 can also have an additional interlocking mechanism to grab onto the last body segment 4 of the plurality of body segments 4. In an exemplary embodiment, turning the endcap 5 in a clockwise direction may tighten the plurality of body segments 4 towards the handle 2 of the training bat 1. Alternatively, turning the endcap 5 in an anti-clockwise direction may loosen the plurality of body segments 4, facilitating removal, replacement or rearrangement of the plurality of body segments 4.

FIGS. 5*a*-5*i* illustrate exemplary variations in the interlocking mechanisms used in the training bat 1 in accordance with some embodiments of the present disclosure. In an embodiment, the interlocking mechanisms may be used to connect the plurality of body segments 4 with each other, or for connecting the endcap 5 to the support rod 3 or for connecting the handle 2 to the plurality of body segments 4. The use of interlocking mechanisms would be particularly crucial for non-cylindrical body segments 4, since without an added interlocking mechanism, the pieces may not hold their relative positions when the training bat 1 is being used. However, circular bats may be an exception for this, as angular shift of the body segments 4 in the circular bats would not alter the shape of the hitting surface of the bat 1.

Figure 5A:
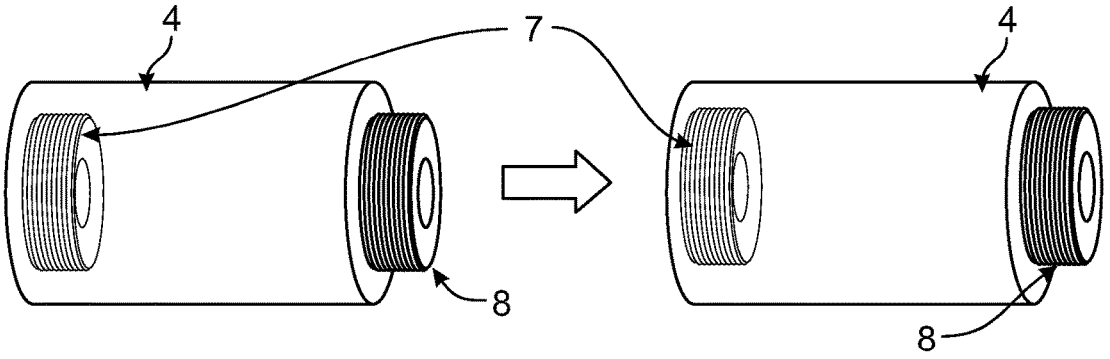
FIGS. 5*a*-5*l* illustrate exemplary variations in the interlocking mechanisms used in the training bat in accordance with some embodiments of the present disclosure.
Figure 5B:
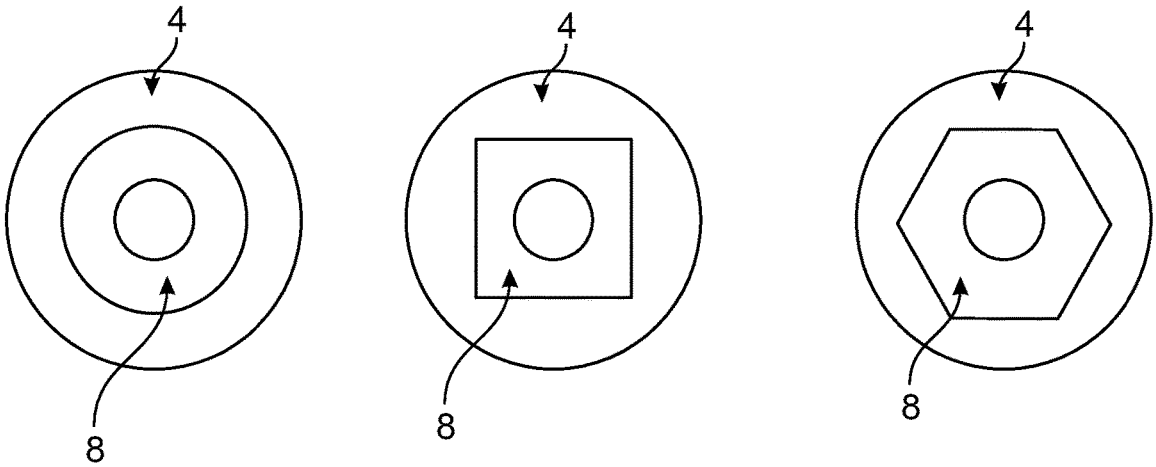
Figure 5C:
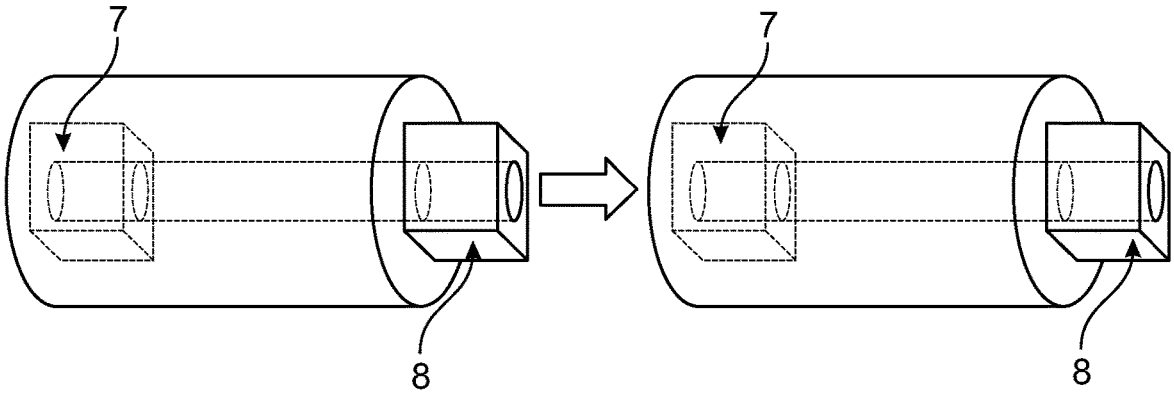
Figure 5D:
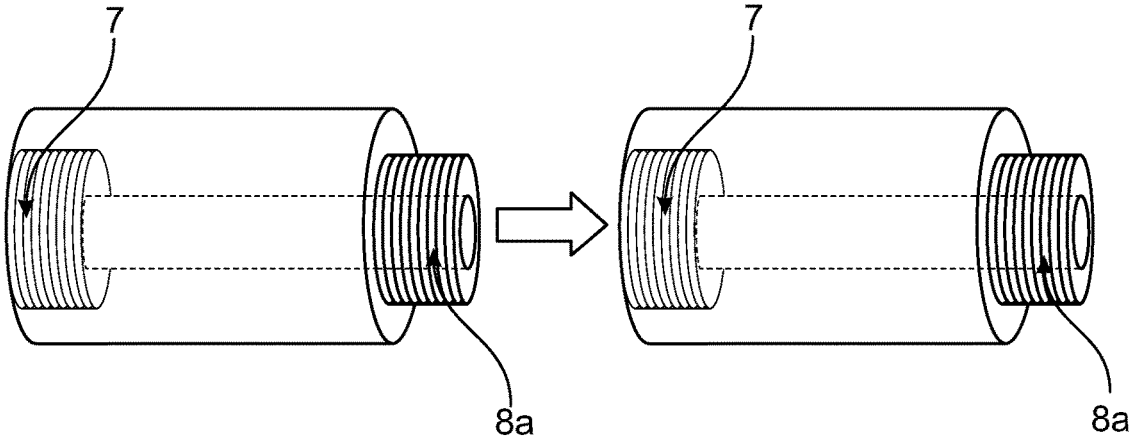
Figure 5E:
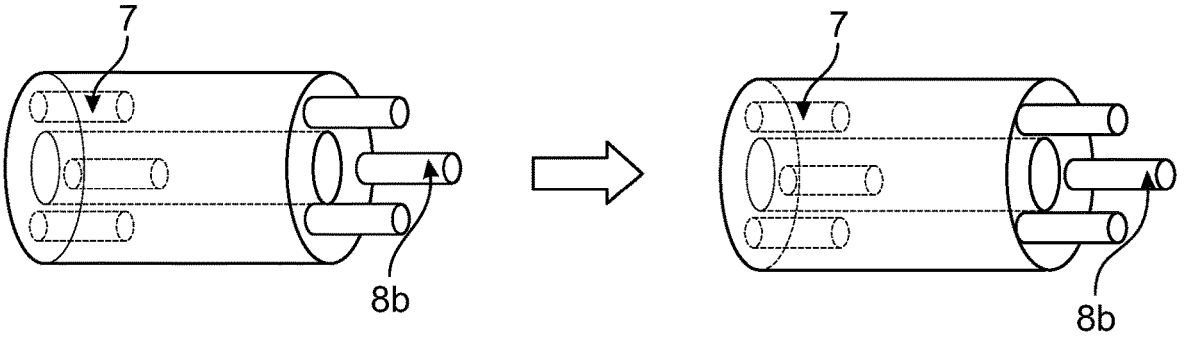
Figure 5F:
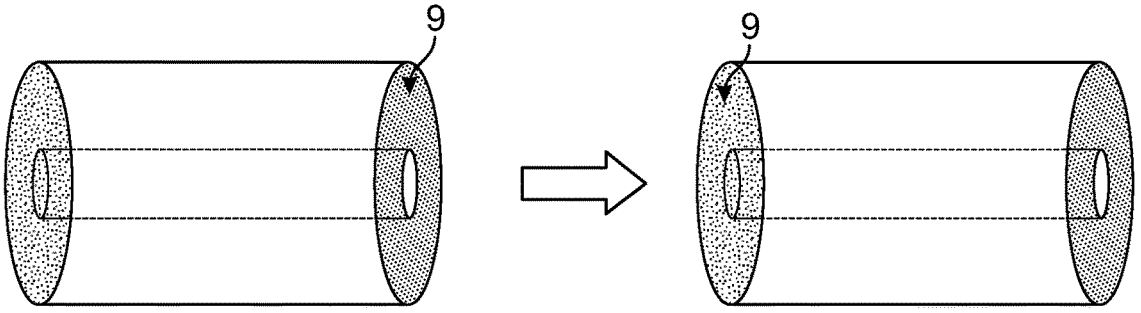

FIG. 5*a* shows one of the variations in the interlocking mechanisms, wherein the plurality of body segments 4 is connected using the threaded intrusions 7 and guided extrusions 8 designed on either side of the plurality of body segments 4. The guided extrusion 8 of the preceding body segment 4 may be inserted into the threaded intrusions 7 of the next body segment 4 to join the two body segments 4. This interlocking will prevent or minimize the lateral movement and angular or rotational movement of the body segments 4 relative to each other. Thus, the interlocking mechanisms also add onto the strength of the bat 1. In an embodiment, the guided extrusions 8 may be of different shapes such as, without limiting to, cylindrical, rectangular, prism-shaped and the like. FIG. 5*b* shows a cross-sectional view of the guided extrusions 8 of different shapes. FIG. 5*c* shows another variation in the interlocking mechanism, wherein the plurality of body segments 4 is connected using the rectangular guided extrusions 8. FIG. 5*d* shows yet another variation of the interlocking mechanism, wherein the plurality of body segments 4 is connected using threaded extrusion 8*a* inserted over the guided extrusions 8. The use of threaded extrusion 8*a* to connect the adjacent body segments 4 will eliminate the lateral shifting between the plurality of body segments 4. FIG. 5*e* shows yet another variation of the interlocking mechanism, wherein dowel pins 8*b* may be used for joining the adjacent body segments 4, instead of the guided extrusions 8. The use of dowel pins 8*b* may reduce the cost of material being used for interlocking and are easy to manufacture. FIG. 5*f* shows yet another variation of the interlocking mechanism, wherein the plurality of body segments 4 is connected using rubberized pads 9, for example, using rubberized, non-slippery surfaces on either side of the plurality of body segments 4. The use of rubberized pads 9 also prevents the relative rotation among the plurality of body segments 4.

Figure 5G:
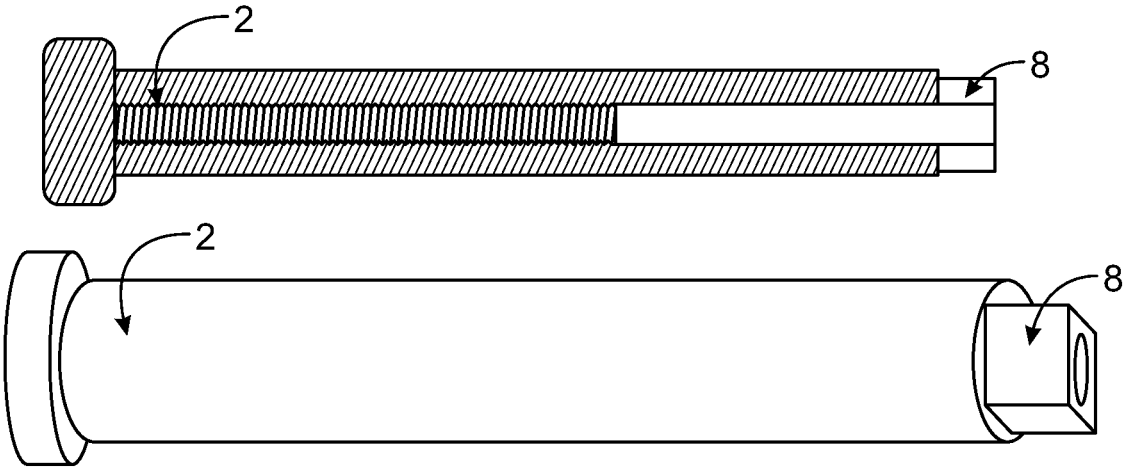

FIG. 5*g* shows a variation of the interlocking mechanism used for connecting the handle 2 with the plurality of body segments 4. In an embodiment, the handle 2 may be provided with a guided extrusion 8 that matches with the extrusion/intrusion on the body segment 4 that immediately connects to the handle 2.

Figure 5H:
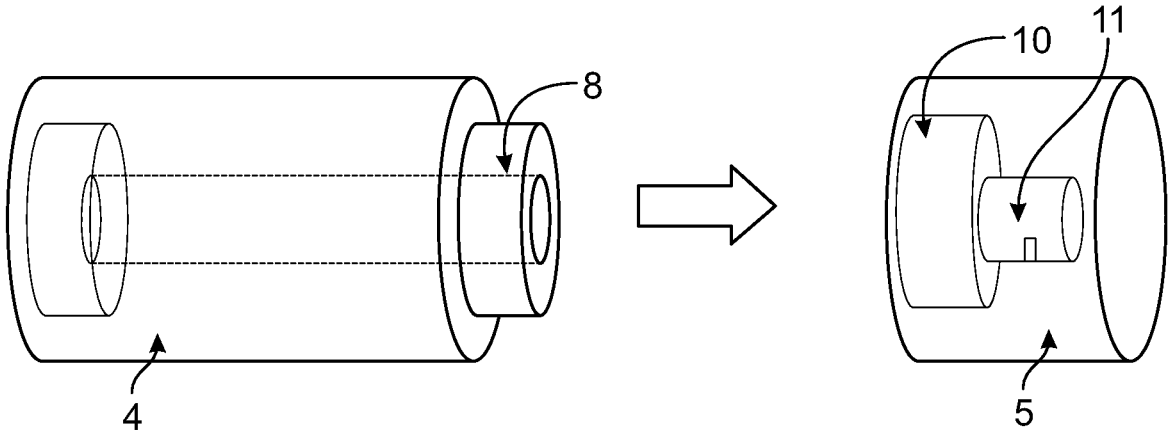
Figure 5I:
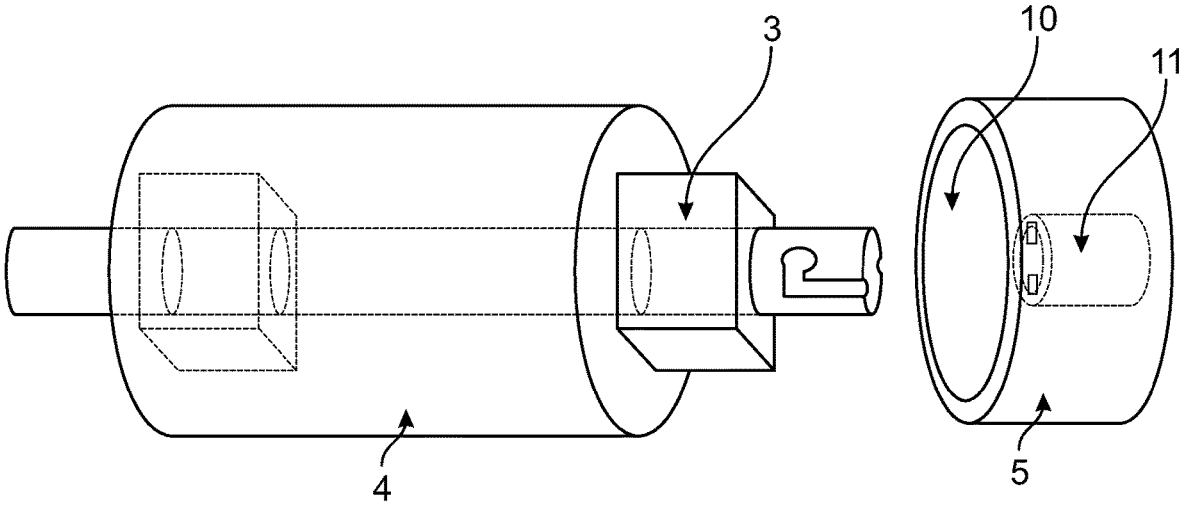

FIG. 5*h* shows a variation of the interlocking mechanism used for connecting the endcap 5 and the body segments 4. In an embodiment, the interlocking mechanism between the endcap 5 and the support rod 3 may be a similar mechanism used for connecting the plurality of body segments 4 with each other. Suppose when the circular extrusions are used for interlocking the plurality of body segments 4, the endcap 5 may be provided with rounded intrusion (shown as 'endcap intrusion 10' in FIG. 5*h*) to attach to the support rod 3 that passes through the last body segment 4 directly connecting to the endcap 5. Additionally, the endcap 5 may have a locking provision 11 for locking on to the support rod 3. FIG. 5*i* shows an interlocking mechanism on the endcap 5 for accommodating the extrusions that are of other shapes than the circular shape. Here, the endcap 5 may have a hollow space (indicated as 'endcap intrusion 10' in FIG. 5*i*) to allow the support rod 3 passing through the last body segment 4 to sit inside the endcap 5.

Figure 5J:
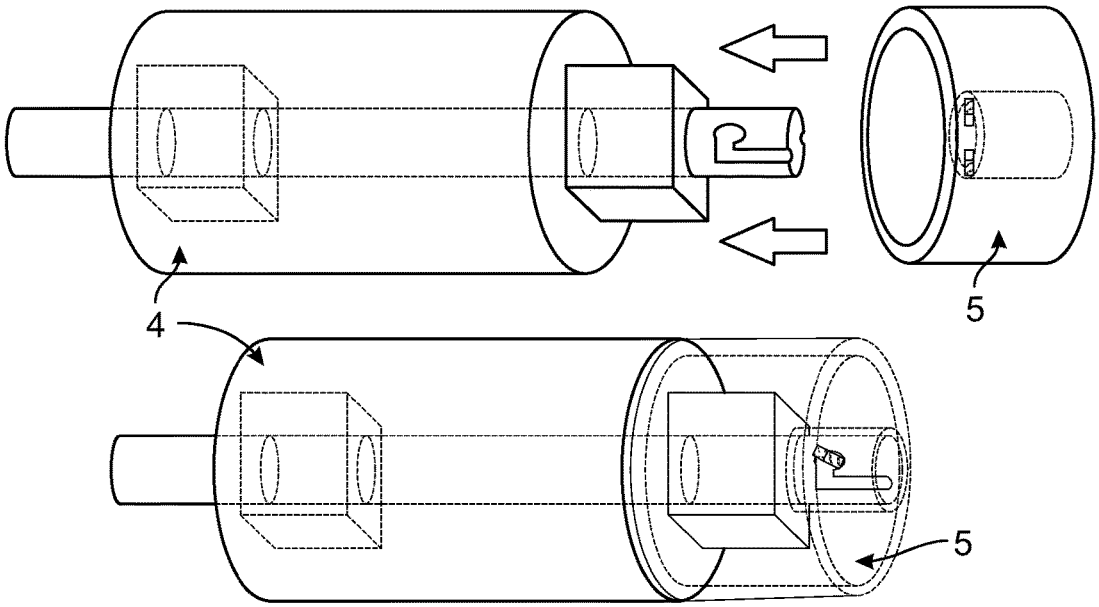

FIG. 5*j* shows endcap 5 for non-cylindrical body segments 4. In an embodiment, hollow endcap 5 with inner diameter that is wide enough to accommodate the extrusions of body segments 4 may be provided. Further, the inner diameter of the endcap 5 does not exceed the outer diameter of the thinnest body segment 4 that can be attached to the distal end 21 of the support rod 3. This is to ensure that the endcap 5 pushes against the body segment 4. Considering that the minimum outer diameter of the body segments 4 may be 1⅛", the endcap 5 should have the inner diameter less than 1⅛". The depth of the endcap 5 should be enough to accommodate the interconnect extrusion within it in entirety with room to spare. It is expected to be approximately 1" deep.

Figure 5K:
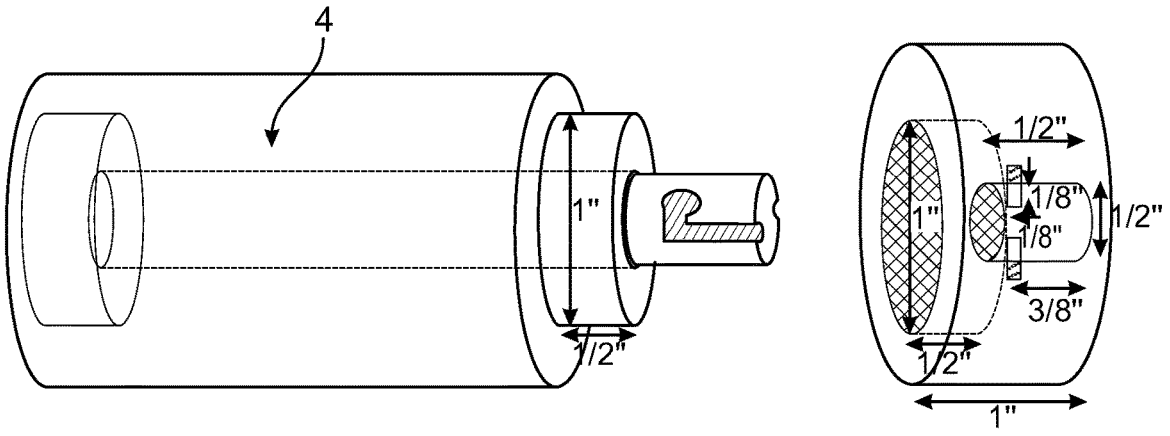

FIG. 5*k* shows dimensions and/or measurements of the endcap 5 used for cylindrical interlocking body segments 4. In an embodiment, the endcap 5 latches on to the support rod 3 and turns it in order to screw it in or out of the handle 2 thereby shortening or lengthening the exposed section of the support rod 3. Consequently, the endcap 5 also loosens or tightens the body segments 4 in between the handle 2 and the endcap 5. The endcap 5 is designed to allow the distal end 21 of the support rod 3 to sit inside it's hollow intrusion of diameter matching that of support rod 3. The endcap 5 should be of sturdy, light-weight material capable of withstanding the forceful impact of a baseball/softball without losing the shape and breaking. The light-weight composites and PVC are suitable for such purposes. The own weight of the endcap 5 should be negligible compared to overall weight of the bat 1. Thus, it should weigh approximately 0.2 oz or less.

Figure 5L:
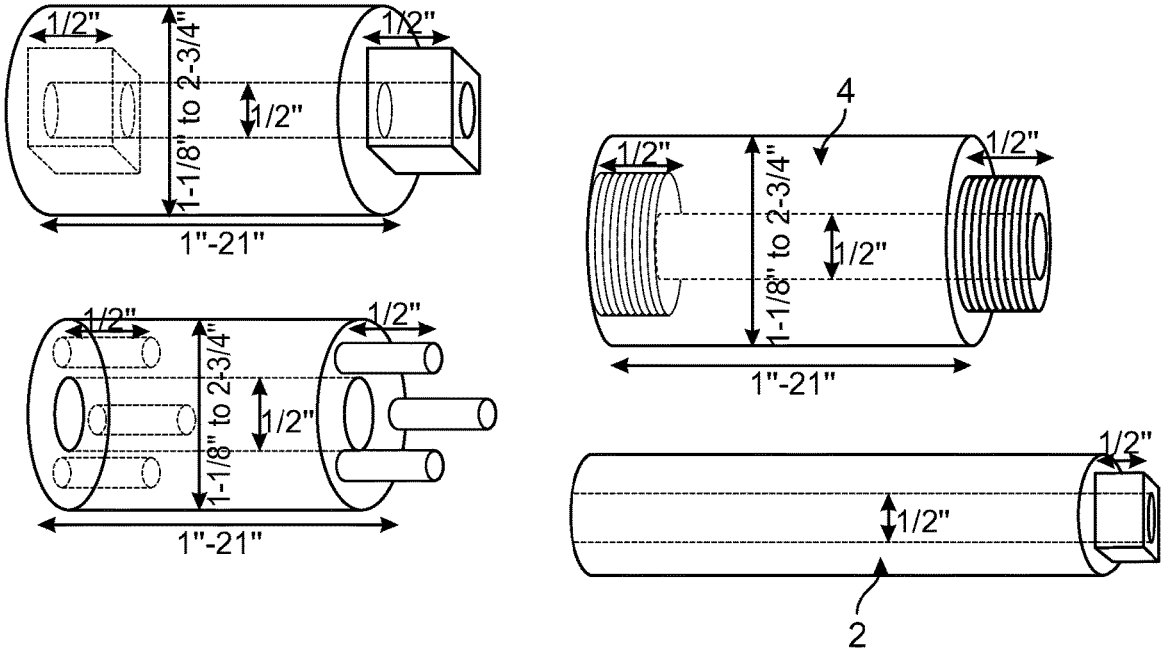

In an embodiment, the endcap 5 is also designed to accommodate the interlocking extrusion of the last body segment 4 at the distal end 21 of the support rod 3. For example, the cylindrical extrusions will sit tightly into the hollow intrusion cut out of the endcap 5 of diameter matching that of the extrusion of the body segment 4. Similarly, the non-cylindrical extrusions, such as rectangular extrusions or dowel pins, will sit loosely within the hollow endcap 5. This is because the endcap 5 is used for turning the support rod 3 to screw it in and out of the handle 2. The turn of the endcap 5 and the support rod 3 would not turn the body segments 4. FIG. 5*l* shows exemplary dimensions and/or measurements of the body segments 4 with associated extrusions and intrusions.

Figure 6A:
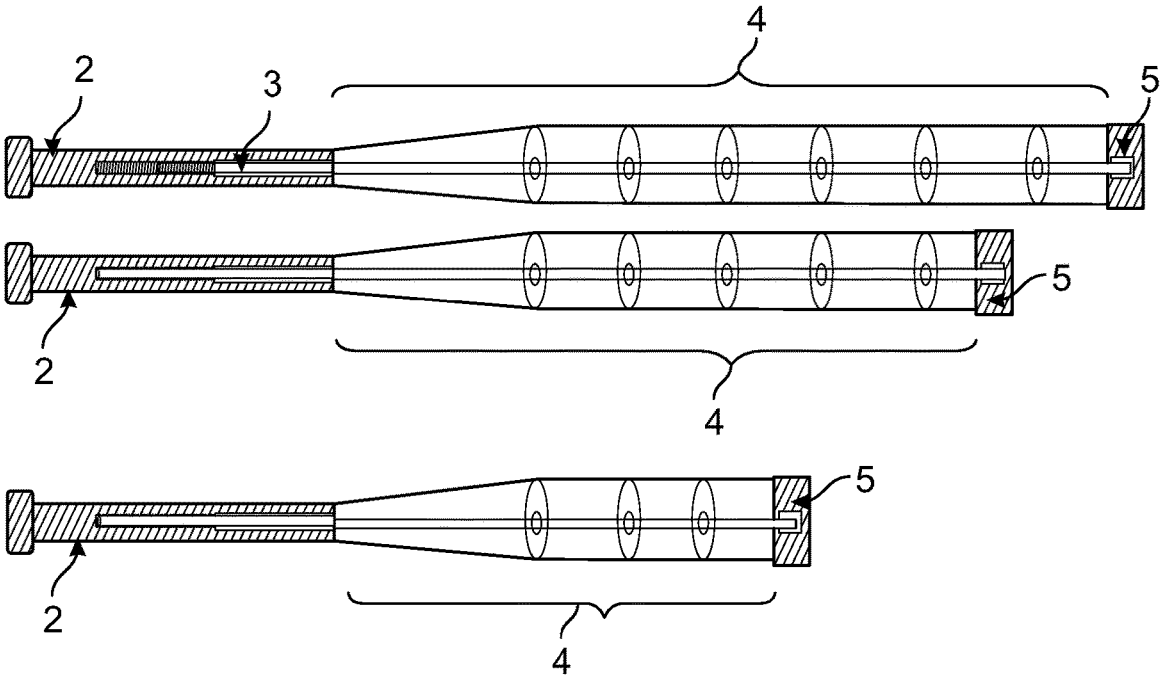
FIG. 6*a* illustrates an exemplary embodiment of varying the length of the training bat in accordance with some embodiments of the present disclosure.

FIG. 6*a* illustrates an exemplary embodiment of varying the length of the training bat 1 in accordance with some embodiments of the present disclosure. According to one embodiment, the length of the training bat 1 may be varied by changing the number of body segments 4 used in the training bat 1. That is, by reducing the number of body segments 4, the length of the training bat 1 reduces and alternatively, the length of the training bat 1 increases when the number of body segments 4 is increased. In an embodiment, the length of the support rod 3 may be varied by changing the extent of support rod 3 inserted into the handle 2. In yet another embodiment, the length of the support rod 3 may be varied by using support rod 3 of different lengths. As an example, a shorter support rod 3 may be used along with lesser number of weighted segments for reducing the length of the training bat 1 for applications like one-handed training.

Figure 6B:
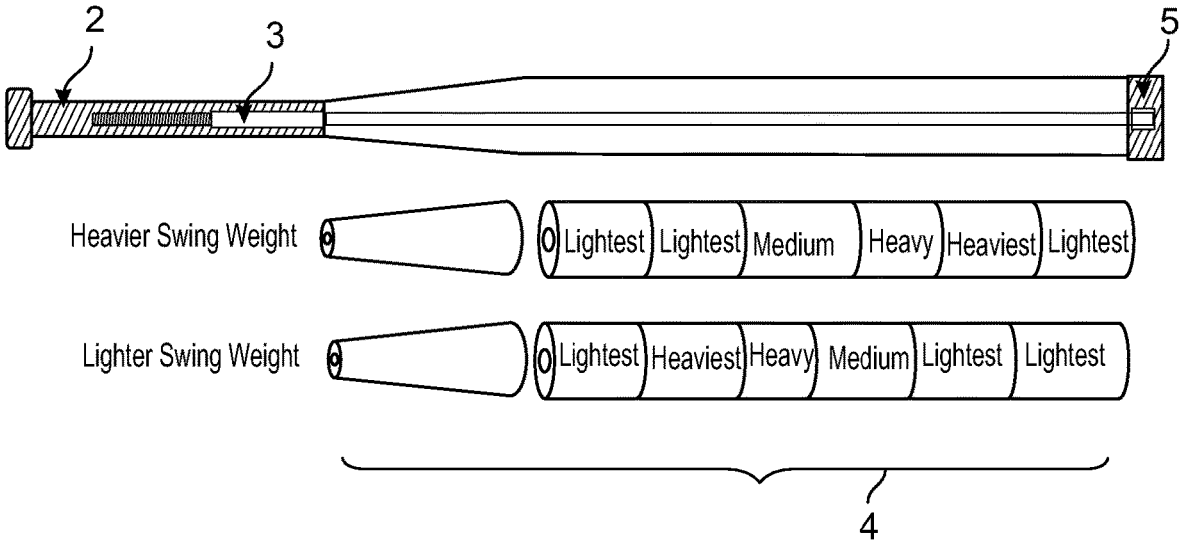
FIG. 6*b* illustrates an exemplary embodiment of varying the swing weight of the training bat in accordance with some embodiments of the present disclosure.

FIG. 6*b* illustrates an exemplary embodiment of varying the swing weight of the training bat 1 in accordance with some embodiments of the present disclosure. In an embodiment, the weight of the training bat 1 may be altered by changing the weights of the body segments 4 used in the training bat 1. The plurality of body segments 4 may be color coded for easily identifying the weight of a particular body segment. The plurality of body segments 4 can be arranged in different arrangements in the middle section of the support rod 3 to create a desired swing weight for the training bat 1. In an embodiment, the swing weight of the training bat 1 may vary based on the position of the weighted segments due to variations in associated moment of inertia of the bat 1 around the handle 2 of the bat 1. Therefore, by altering the weight distribution, the moment of inertia of the bat 1 can be varied, thereby making the bat 1 heavy or lighter, while the length of the bat 1 remains the same. As an example, when the center of mass of the bat 1 is away from the handle 2 of the bat 1, the bat 1 feels heavier to swing.

In an embodiment, a plurality of body segments 4 of varying size, weight and shapes may be used to customize the training bat 1. Some of the body segments 4 can be distinct from other based on their weight and can be identified using markings or colored outer surface. All the body segments 4 may have a hole in the middle to slide onto the support rod 3 smoothly. The diameter of the hole is about the same as the diameter of the support rod 3, which is approximately ½". In an embodiment, the body segments 4 can have interlocking mechanisms to latch on to the handle 2 as well as the adjoining body segments 4. By arranging the body segments 4 of different thickness, weights and shapes on the support rod 3, the overall shape and swing weight of the training bat 1 can be altered to be used for training specific skill. Thickness can mean diameter of the body segments for baseball and softball bats or width and depth of body segments for the cricket bat.

In an embodiment, the length of each body segment 4 should be from a minimum of approximately 1" to a maximum of approximately 30". Most common length of the body segments 4 may be between 4" to 8". The 1" long segment provides flexibility to increase the length of the training bats 1 in increments of 1" at a time. The maximum length of body segments 4 can be long enough to cover the exposed support rod 3 in its entirety.

In an embodiment, narrow width body segments 4 are used for building the slim profile bats. Here, the body segments 4 should have thickness ranging from 1⅛" to 1¾". The wider body segments 4 are used for creating thickness profile of a standard/regulation bat 1. The thickness of such body segments 4 range from 1⅞" to 2¾" for baseball training bats, 1⅞" to 2¼" for softball training bats and 34" for cricket training bats. The thickness profile is the variation in diameter or width and depth of the bat.

In an embodiment, most of the body segments 4 may be made of lightweight material such as PVC, composite material like carbon fiber or lightweight Aluminum alloy. One or more heavier body segments 4 may be arranged along with the lighter body segments 4 to create a desired swing weight. The weight of each body segment 4 should range from 0.2 oz on the lighter side to 16 oz on the heavier side. In an embodiment, how heavy the bat 1 feels to an athlete will depend on not just the overall weight of the bat 1, but also how the weight is distributed along the length of the bat 1. The bat 1 feels lighter or heavier depending on the moment of inertia of the bat 1. This is called swing weight of the bat 1. The swing weight of the bat 1 can be varied by positioning heavy body segments further away from the handle 2, increasing the distance from an axis of rotation of the bat 1.

In an embodiment, since the hitting section of the bat 1 is made of plurality of body segments 4 arranged on the support rod 3, the overall strength of the bat 1 is not expected to be same as that of bats designed solely for hitting actual baseball/softball or cricket balls. Therefore, it is expected that the bat 1 may be used primarily to hit the lighter smush balls or wiffle balls. Thus, any material that can withstand the impact to such balls can be used for the body segments 4. In an embodiment, the heavier body segments 4 can be created by using weighted fillers inside hollow segments or by using heavier material such as wood or metal to construct the body segments 4.

Figure 6C:
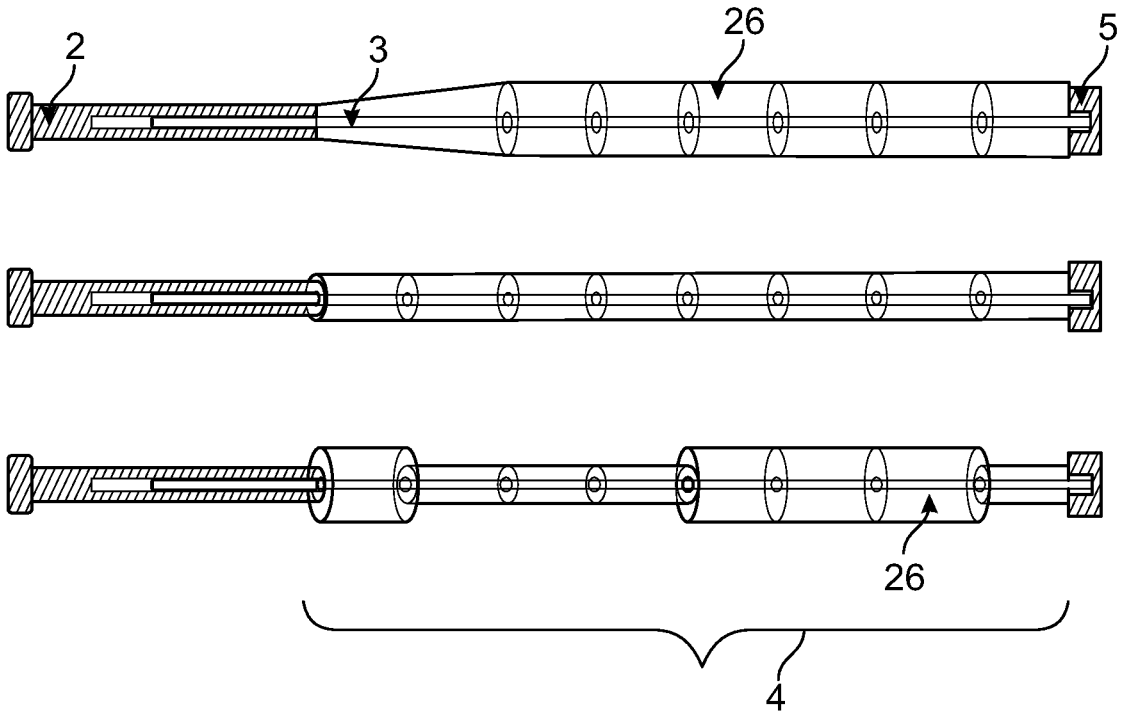
FIG. 6*c* illustrates an exemplary embodiment of varying the thickness profile of the training bat in accordance with some embodiments of the present disclosure.

FIG. 6*c* illustrates an exemplary embodiment of varying the thickness profile of the training bat 1 in accordance with some embodiments of the present disclosure. In an embodiment, the thickness profile of the training bat 1 may be varied by using body segments 4 of different thickness. In a typical bat, the thickness of the hitting region would be more than the thickness of the handle 2 and the thickness of the hitting region remains approximately uniform throughout. Alternatively, in a slim bat, the thickness of the hitting region may be approximately similar to the thickness of the handle 2, which is less than the thickness of the hitting region of a typical bat 1 known in the art. A slim bat may be used for improving the hand-eye coordination of the athletes. An embodiment, the thickness and weight of the body segments may be non-uniformly distributed along the length of the bat to enhance the swing mechanics of the athlete. The weight of the bat 1 may be distributed around the handle 2 and the barrel 26, which is the hitting region of the bat 1, to encourage the athlete to move his arms and upper body in a manner that minimizes the effort required to swing the bat, thereby improving swing mechanics. The weight of bat 1 is increased in the proximal end 22 of the handle using a weighted knob 13 and heavy body segments 4 near distal end 23 of the handle 2 and the barrel 26 (i.e., near the endcap 5 of the bat 1).

Figure 6D:
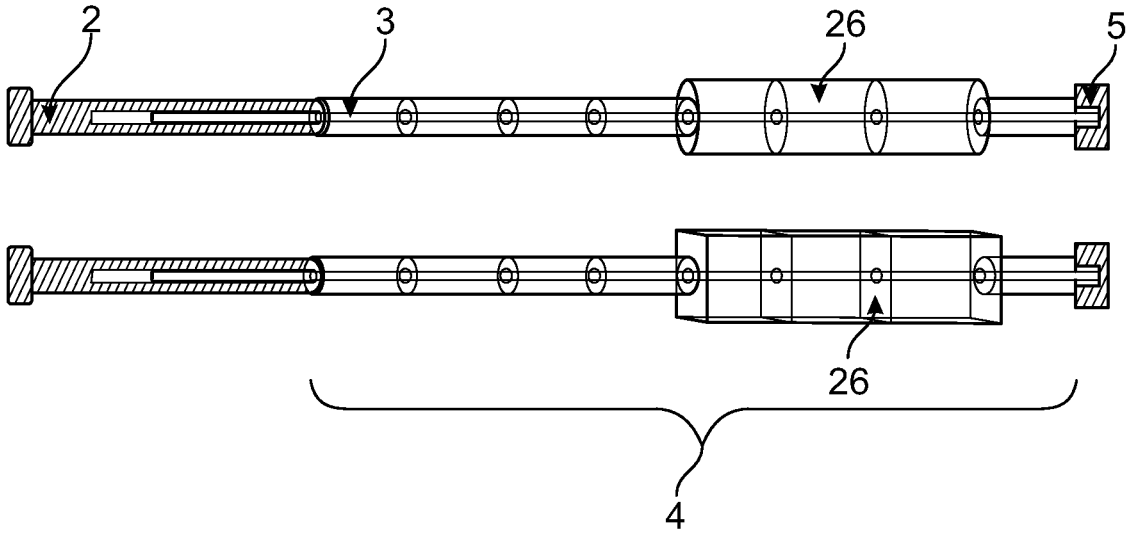
FIG. 6*d* illustrates an exemplary embodiment of varying the barrel profile of the training bat in accordance with some embodiments of the present disclosure.

FIG. 6*d* illustrates an exemplary embodiment of varying the barrel profile of the training bat 1 in accordance with some embodiments of the present disclosure. The barrel profile is defined by shape and size of the barrel 26. In an embodiment, the diameter of the plurality of body segments 4 used in the bat 1 may be varied to create different thickness profiles for the bat 1. As an example, the diameter or thickness of the body segments 4 placed towards the endcap 5 of the bat 1 may be increased to create a thickness profile that is most suitable for training hitting of the sweet spot of the bat 1. Similarly, a set of rectangular body segments 4 may be loaded near the endcap 5 region to provide a thickness profile that is suitable for training for hitting the sweet spot with correct swing path.

Figure 7A:
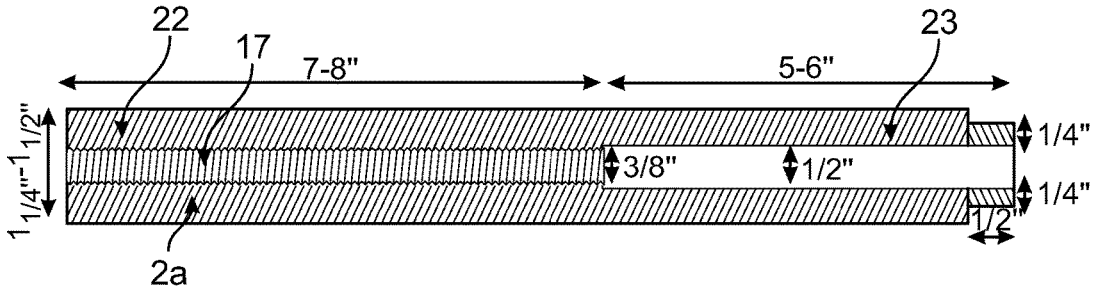
FIGS. 7*a*-7*e* illustrate exemplary variations in the handle of the training bat in accordance with some embodiments of the present disclosure.

FIGS. 7*a*-7*e* illustrate exemplary variations in the handle 2 of the training bat 1 in accordance with some embodiments of the present disclosure. In one embodiment, a bore may be run through the length of the handle 2 for creating an internally threaded region in the handle 2. The handle 2 may be made of wood and have a uniform thickness, as shown in FIG. 7*a*. The wooden handle 2*a* may be thicker and used, for example, in the cricket bats. In an embodiment, the material used for the wooden handle 2*a* may include, without limiting to, maple wood, ash wood, birch wood, bamboo, willow and the like. The wooden handle 2*a* optionally comprises a knob. In an exemplary non-limiting embodiment, the length of the wooden handle 2*a* may be 12"-14" and the grip around the wooden handle 2*a* may have a thickness of 0.5 mm-1.8 mm. Further, the outer diameter may be in the range of 1.25"-1.50", while the inner diameter is in the range of ⅜"-½". Further, the inner slot length may be 12"-14" extending into the wooden handle 2*a*, in which, a region of length 7-8" may be threaded with a ⅜" thickness and a region of length 5-6" may be unthreaded with a thickness of ½". Further, the extrusions on the wooden handle 2*a* may have a thickness of ¼" and with ½" length, as indicated in FIG. 7*a*.

Figure 7B:
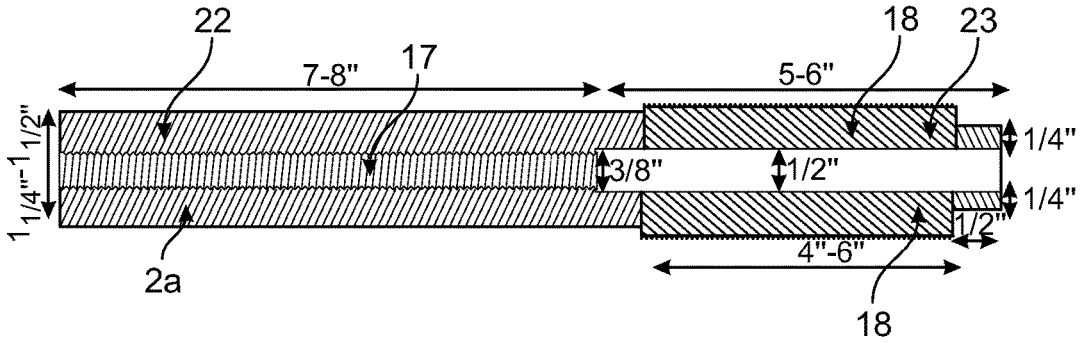

FIG. 7*b* shows a wooden handle 2*a* with uniform thickness and having threads. In an embodiment, in order to connect the casing 6 of the training bats 1 with uniform thickness, the handle 2*a* may be provided with threads on the outside surface of the distal end 23 of the handle 2*a*. These threads run a length of at least 4" to allow the length adjustment of the training bat 1 by screwing the casing 6 along the length of the handle 2*a*.

Figure 7C:
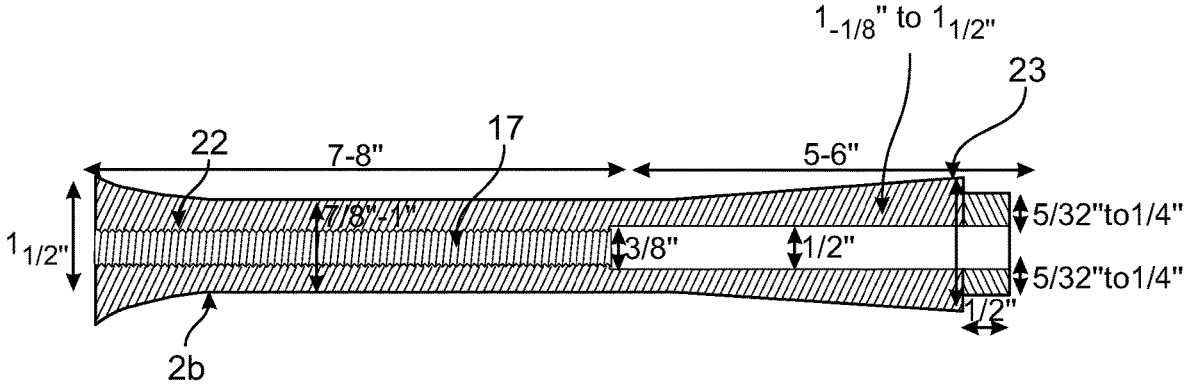

FIG. 7*c* shows a tapered wooden handle 2*b*. The tapered wooden handle 2*b* may be suitable for baseball bats and come with limited length adjustability. The tapered wooden handle 2*b* may be designed to accommodate an optional weighted knob, which is detachable or swappable. The length of the tapered wooden handle 2*b* may vary between 12-14" and the thickness of the grip may be of 0.5-1.8 mm. The outer diameter at the proximal end 22 (i.e., near the weighted knob) may be 1.5", while the outer diameter on the distal end 23 may be 1.125-1.5". Further, the outer diameter for the majority of the tapered wooden handle 2*b* on the center region may be 0.875"-1". In an embodiment, the inner slot/bore length may be 12-14" extending throughout the length of the tapered wooden handle 2*b*, in which, a region of length 7-8" may be threaded with a ⅜" thickness and a region of length 5-6" may be unthreaded with a thickness of ½". Further, the extrusions for interconnecting may have a thickness of 5/32"-¼" with a length of ½", as indicated in FIG. 7*c*.

Figure 7D:
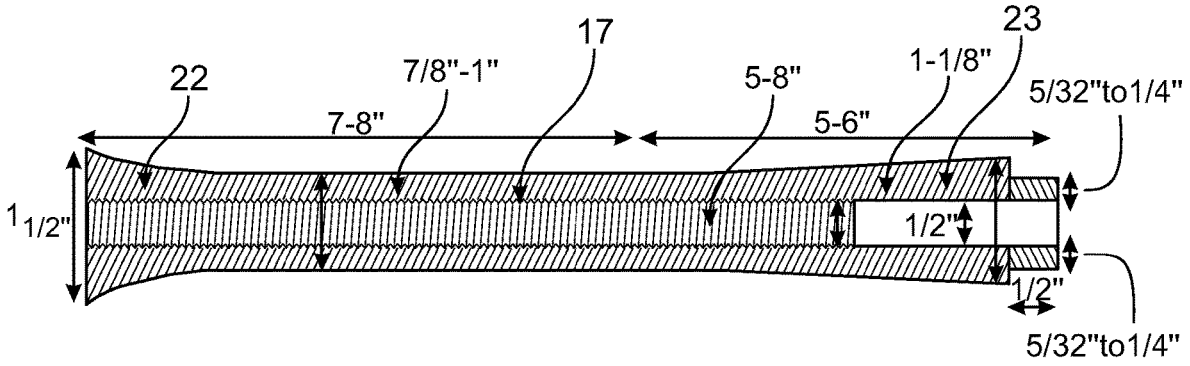

FIG. 7*d* shows a tapered metal/composite handle 2*c* which provides better length adjustability compared to the tapered wooden handle 2*b*. Even the tapered metal handle 2*c* allows connecting the knob to the bat 1. The tapered metal handle 2*c* may be made of a metal, such as an Aluminum alloy, or a composite material like carbon fiber. The length of the tapered metal handle 2*c* may be 12"-14" and the grip may have a thickness of 0.5-1.8 mm. The outer diameter at the proximal end 22 may be 1.5", while the outer diameter on the distal end 23 may be 1.125". Further, the outer diameter for the majority of the tapered metal handle 2*c* on the center region may be 0.875"-1". In an embodiment, the inner slot/bore length may be 12-14" extending throughout the length of the tapered metal handle 2*c*, in which, a region of length 7-8" may be threaded with a ⅜" thickness and a region of length 5-6" may be unthreaded with a thickness of ½". Further, the extrusions for interconnecting may have a thickness of 5/32"-¼" with a length of ½", as indicated in FIG. 7*d*.

Figure 7E:
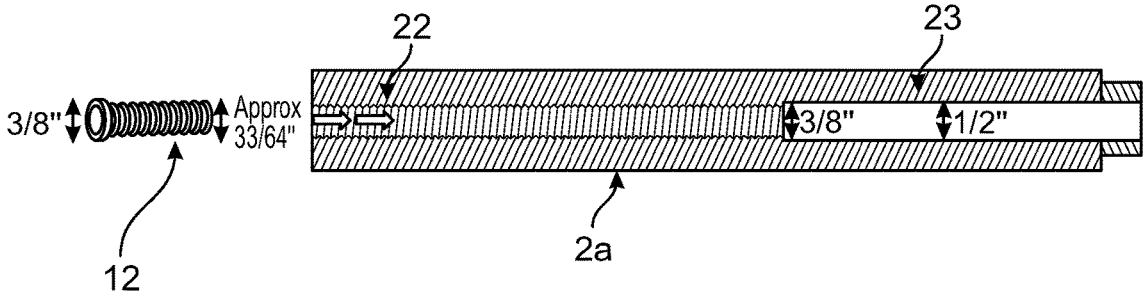

FIG. 7*e* illustrates providing a threaded insert 12 to the wooden handle 2*a*. In an embodiment, the threads of the metal support rod 3 may erode the threads of the softer wooden handle 2*a* over time and usage. Therefore, a threaded insert 12 may be provided on the proximal end 22 of the wooden handle 2*a*. The length of the threaded insert 12 is same as the length of the threaded slot needed within the wooden handle 2*a*. The inner diameter of the threaded insert 12 matches the diameter of the thread of the support rod 3. The threaded insert 12 may be inserted, screwed and tightened into the bore through the proximal end 22 of the wooden handle 2*a* during the manufacturing process. In an embodiment, the threaded insert 12 may be inserted after drilling a bore of diameter about 33/64". The inner diameter of the threaded insert 12 may be ⅜". FIG. 7*e* shows an exemplary use of a threaded insert 12.

Figure 8A:
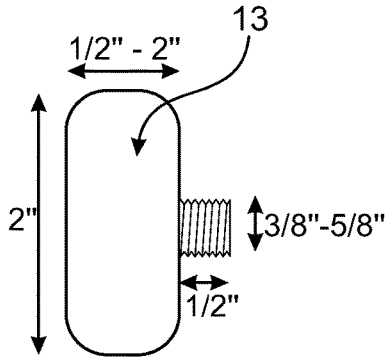
FIGS. 8*a*-8*b* illustrate exemplary variations in the detachable knob of the training bat in accordance with some embodiments of the present disclosure.
Figure 8B:
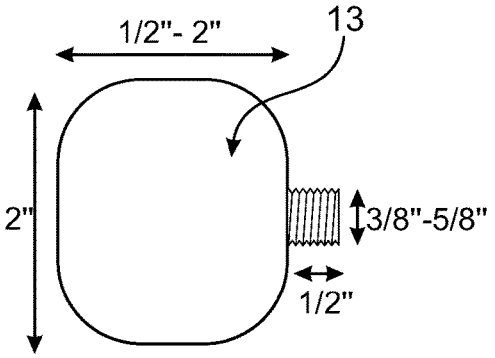

FIGS. 8*a*-8*b* illustrates exemplary variations in the knob 13 of the training bat 1 in accordance with some embodiments of the present disclosure. In an embodiment, the knob 13 may be made of wood (such as maple, ash, birch, bamboo, willow) or a metal (such as Aluminum alloy). As shown in FIG. 8*a*, a knob 13 of standard dimensions may have a diameter of 2" and length of ½". The weight of the knob 13 may range between 0.2-0.6 oz. The length of the extrusion may be ½", while the thickness of the extrusion ranges between ⅜"-⅝".

FIG. 8*b* illustrates a weighted knob 13 which may be used to train the swing mechanics of the athlete by adding weight to the proximal end 22 of the handle 2. In an embodiment, the weighted knob 13 may be made of wood (such as maple, ash, birch, bamboo, willow) or a metal (such as Aluminum alloy, galvanized Zinc, cast Iron and stainless steel). Further, the weighted knob 13 may have a diameter of 2" and a length of ½"-2". The weight of the weighted knob 13 may range between 2-20 oz. The length of the extrusion may be ½", while the thickness of the extrusion ranges between ⅜"-⅝". In an embodiment, the weighted knob 13 may be made of either a single solid piece or a hollow piece with weighted filler material.

Figure 9A:
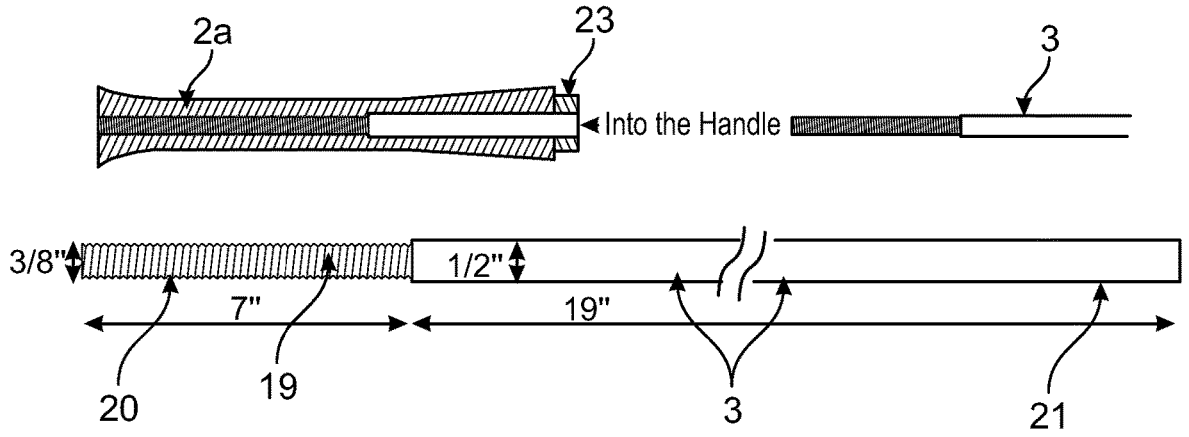
FIGS. 9*a*-9*c* illustrate exemplary variations in the support rod of the training bat in accordance with some embodiments of the present disclosure.
Figure 9B:
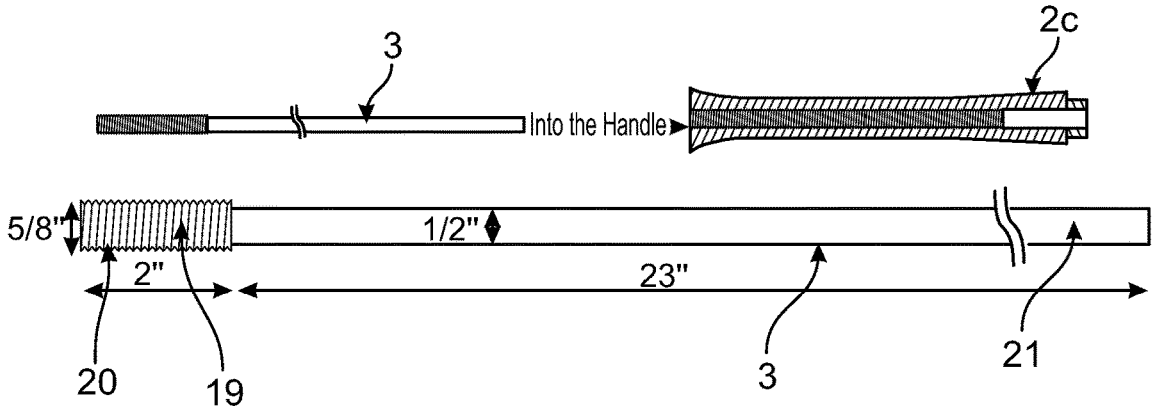
Figure 9C:
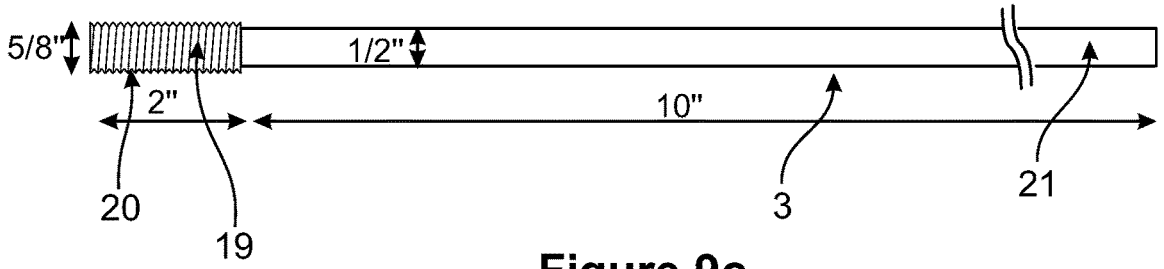

FIGS. 9*a*-9*c* illustrate exemplary variations in the support rod 3 of the training bat 1 in accordance with some embodiments of the present disclosure. FIG. 9*a* shows a support rod 3 that may be inserted into a wooden handle 2*a*. Such a support rod 3 may comprise narrow threaded region on the proximal end 20 of the support rod 3 and can be inserted into the wooden handle 2*a* through the distal end 23 of the wooden handle 2*a*. In an embodiment, the length of the support rod 3 may be 26" including a 19" unthreaded region and a 7" threaded region. The support rod 3 has an outer diameter of approximately ½" unthreaded and ⅜" when threaded. The material used may be zinc-plated steel or galvanized steel. The unthreaded region may have a smooth surface.

FIG. 9*b* shows a support rod 3 that may be used with a metal handle 2*c*. Here, the support rod 3 may have a wider threaded region and may be inserted into the metal handle 2*c* through the proximal end 22 of the metal handle 2*c*. In an embodiment, the length of the support rod 3 may be 25" including a 23" unthreaded region and a 2" threaded region. The outer diameter may be approximately ½" on the unthreaded region and ⅝" on the threaded region. The material used may be zinc-plated steel or galvanized steel. The unthreaded region may have a smooth surface.

FIG. 9*c* shows a short support rod 3 for metal handle 2*c* used in a single-hand training bat 1. In an embodiment, the length of the support rod 3 may be 12", including a 10" unthreaded region and a 2" threaded region. The support rod 3 has an outer diameter of approximately ½" on the unthreaded region and ⅝" on the threaded region. The material used may be zinc-plated steel or galvanized steel. The unthreaded region may have a smooth surface.

Figure 10A:
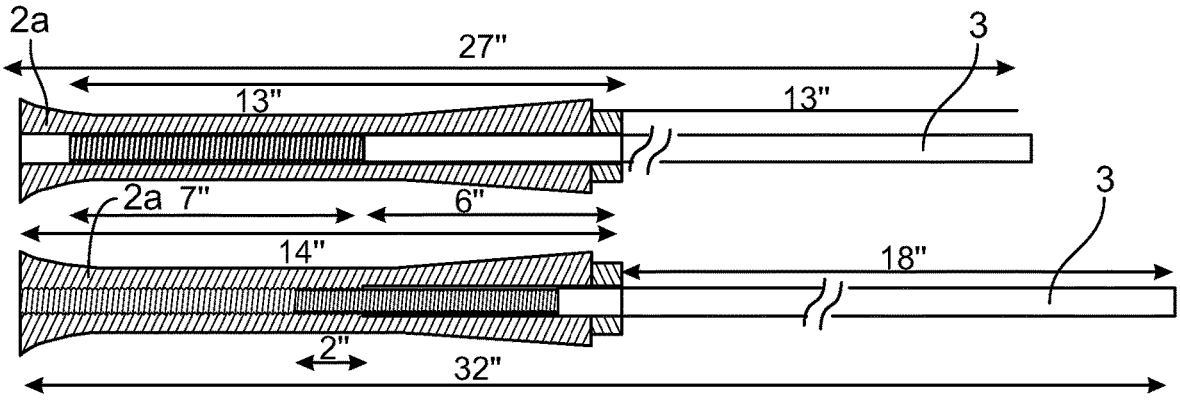
FIGS. 10*a*-10*c* illustrates exemplary embodiments of adjusting the length of the training bat in accordance with some embodiments of the present disclosure.
Figure 10B:
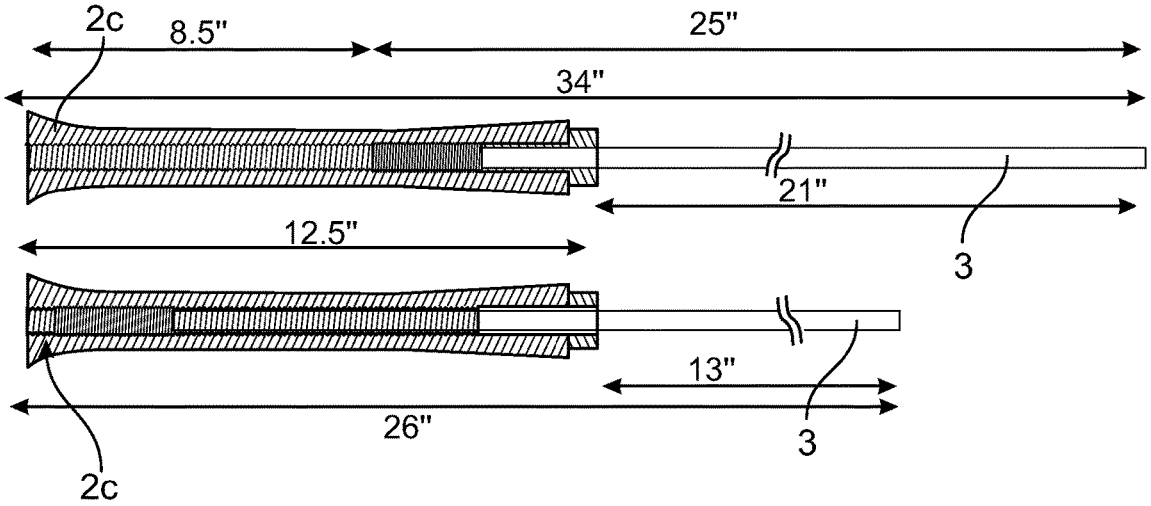
Figure 10C:
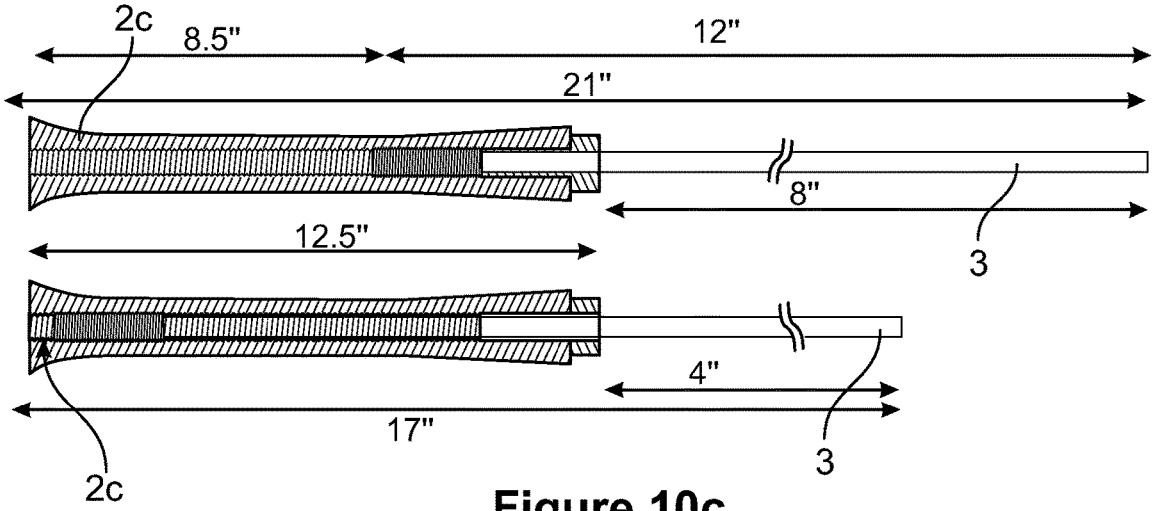

FIGS. 10*a*-10*c* illustrates exemplary embodiments of adjusting the length of the training bat 1 in accordance with some embodiments of the present disclosure. Particularly, FIG. 10*a* shows length adjustability in case of a wooden handle 2*a*. In an embodiment, the overall length of the training bat 1 may be approximately adjusted between 27"-32". That is, the overall length of the training bat 1 may be varied by 5". Here, the length of the support rod 3 may be 26", out of which, the maximum length for which the support rod 3 can be inserted into the wooden handle 2*a* is 13" and the minimum length of the support rod 3 that remain outside the wooden handle 2*a* is 13". In other words, the minimum of approximately 13" of the support rod 3 extends outward from the distal end 23 of wooden handle 2*a*, thereby making the total bat length as 27" (i.e., 13"+14"). Further, the maximum of approximately 18" of the support rod 3 extends outward from the distal end 23 of wooden handle 2*a*, thereby making the total bat length as 32" (i.e., 18"+14"), as illustrated in FIG. 10*a*. That is, approximately 2" of the support rod 3 remains screwed inside the threaded section of the handle 2*a*.

FIG. 10*b* illustrates length adjustability for a metal/composite handle 2*c*. In an embodiment, the maximum length adjustability for the training bat 1 using a metal handle 2*c* may be 8". The overall adjustable length of the bat 1, including the endcap 5 and the knob 13 may be approximately 26"-34". The support rod 3 length may be 25", wherein the minimum length inside the metal handle 2*c* is 4" and the maximum length outside the metal handle 2*c* may be 21". The support rod 3 is positioned within the bore and preferably has an outer diameter of approximately ⅝" so that it fits tightly within the bore. Also, the support rod 3 preferably has a total length of approximately 25" and extends within the metal handle 2*c* towards the end of the bore, so that the minimum of approximately 13" of the support rod 3 extends outward from the distal end 23 of the metal handle 2*c*, thereby making the minimum length of the bat 1 as 26". Similarly, a maximum length of 21" of the support rod 3 is extended outward from the distal end 23 of the metal handle 2*c*, thereby making the total of the bat 1 as 34", as indicated in FIG. 10*b*.

FIG. 10*c* illustrates length adjustability for metal handle 2*c* used for single-handed training bat 1. In an embodiment, the maximum length adjustability may be 4". The overall adjustable length of the bat 1, including the endcap 5 and the knob 13 may be approximately 17"-21". The length of the support rod 3 may be 12", wherein the minimum length inside the metal handle 2*c* is 4" and the maximum length outside the metal handle 2*c* may be 8". The support rod 3 is positioned within the bore and preferably has an outer diameter of approximately ⅝" so that it fits tightly within the bore. Also, the support rod 3 preferably has a total length of approximately 12" and extends within the metal handle 2*c* to the end of the bore, so that the minimum of approximately 4" of the support rod 3 extends outward from the distal end 23 of the metal handle 2*c*, thereby making the minimum length of the bat 1 as 17". Similarly, a maximum length of 8" of the support rod 3 is extended outward from the distal end 23 of the metal handle 2*c*, thereby making the total of the bat 1 as 21", as indicated in FIG. 10*c*.

Figure 11A:
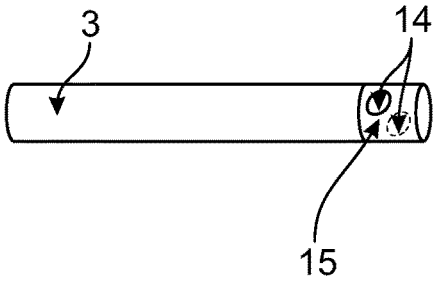
FIGS. 11*a*-11*b* illustrate variations in the distal end of the training bat in accordance with some embodiments of the present disclosure.
Figure 11B:
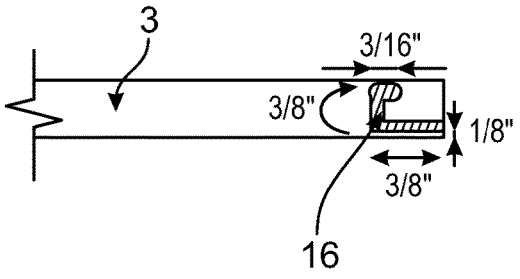

FIGS. 11*a*-11*b* illustrate variations in the distal end of the training bat 1 in accordance with some embodiments of the present disclosure. In an embodiment, the endcap 5 may be connected to the support rod 3 using various interlocking mechanisms. FIG. 11*a* illustrates use of spring-loaded pin that aligns and locks into pin holes 14 provided on the distal end 21 of the support rod 3. As an example, the support rod 3 may have a hollow section 15 and one or more pin holes 14. If two pin holes 14 are used, they may be positioned on opposite ends of the cross section. The pin holes 14 may have an approximate diameter of 3/16". The length of the hollow section 15 may be ½". The outer diameter of the distal end 21 is ½" and inner diameter of the distal end 21 is 7/16". Further, as shown in FIG. 11*b*, the support rod 3 may comprise the groove cut region 14 on the distal end 21 of the support rod 3 to get attached to a fixed dowel pin extrusion coming out of the endcap 5. The spring-loaded pin may have an approximate thickness of ⅛" and the depth of the groove may be ⅛".

Figure 12A:
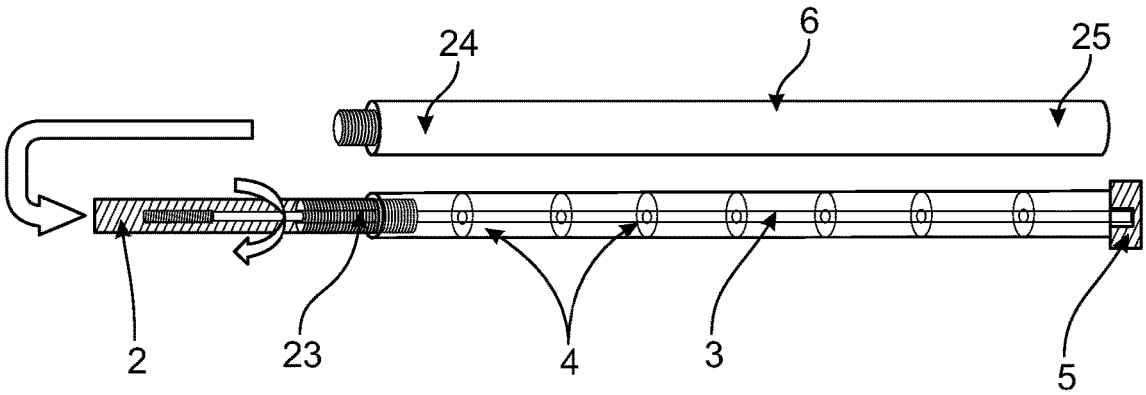
FIGS. 12*a*-12*b* illustrate exemplary embodiments related to casing of the training bat in accordance with some embodiments of the present disclosure.
Figure 12B:
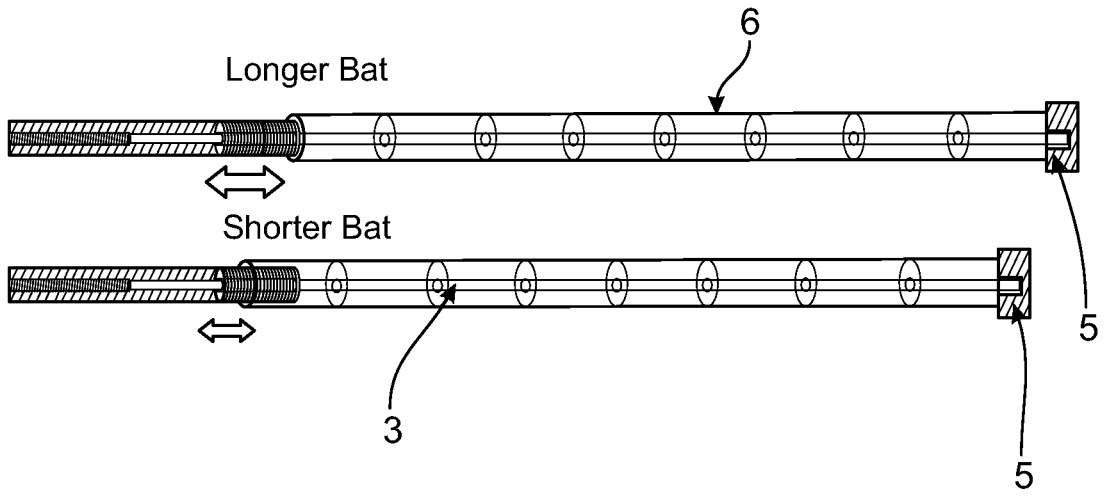
Figure 12C:
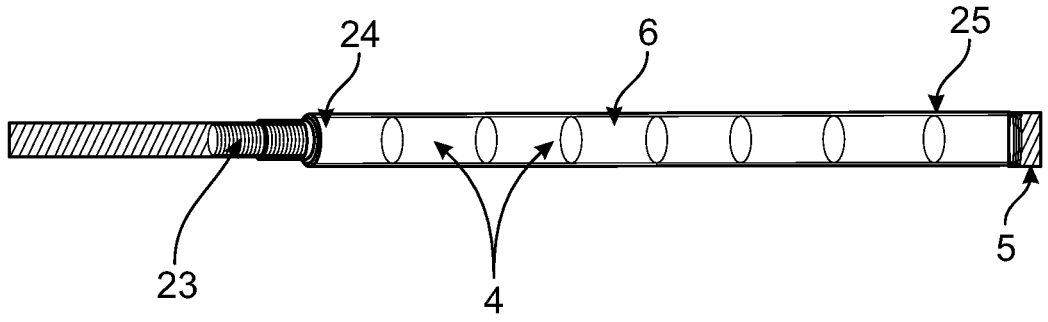

FIGS. 12*a*-12*c* illustrate exemplary embodiments related to casing of the training bat in accordance with some embodiments of the present disclosure. Generally, when the casing 6 is used, all the body segments 4 are of same width forming a cylindrical body, as shown. The casing 6 protects the body segments 4 from damage when hitting with harder and heavier balls. The casing 6 is a hollow cylindrical tube that sits over the body segments 4 and has inner diameter barely big enough to go over the body segments 4. In an embodiment, the casing is screwed onto the threads of the outer surface of the un-tapered cylindrical handle of uniform thickness. This design uses longer handle 2 of about 14" in length with about 4" of distal end 23 threaded on the outer surface. In an embodiment, a circular groove around the outer circumference of the endcap 5 may be provided to receive the distal end 25 of the casing 6 and hold it in place during the usage, as shown in FIG. 12*a*. In another embodiment casing 6 is strong enough by itself that added support from the support rod 3 is no longer needed. Hence, the handle 2 and endcap 5 have no slots/bore within them to receive the support rod 3 and connect. The body segments 4 do not need a hole in the center to receive the support rod 3. Further, the endcap 5 is threaded to screw on to the distal end 25 of the casing 6. Handle 2 has threads on outside at the distal end 23 to receive the casing 6 and screw on it for connection and length adjustment.

In an embodiment, the proximal end 24 of the casing 6 sits on top of the handle 2 and has threads inside to screw on to the threads on the distal end 23 of the handle 2. In order to attach the casing 6, the knob is removed and the casing 6 is slid, on the wider end, on to the handle 2 until the wider threads at the end of handle 2 meet the threads on inside of the neck of casing 6. The casing 6 is then turned on top of threads of handle 2 to make it go down the desired length of bat 1. The length of the thread on outside of the handle 2 provides the adjustability of the length of the casing that covers the body segments 4. Alternatively, the casing 6 is slid on to the distal end 23 of the handle 2 before the support rod 3 and body segments 4 are connected to the handle 2.

FIG. 12*b* illustrates the length adjustability of the bat 1 by screwing the casing 6 on to the handle 2 to meet the endcap 5 at the desired length. In an embodiment, the casing 6 should be made of sturdy material such as composites, carbon fibers and plastics that can withstand the hitting balls without dents and breakage. The casing 6 is lightweight such that the overall swing profile of the bat 1 can be changed significantly by placing the heavier body segments 4 at varying distance along the length of the support rod 3.

It shall be noted that various dimensions of the training bat 1 discussed in the above sections of the complete specification are only approximate values and may be changed as per requirement of the athlete and/or manufacturer of the training bat 1.

Advantages of the Proposed Disclosure

In an embodiment, the present disclosure provides a customizable training bat, whose shape, size, length, weight and thickness may be customized according to the needs and preferences of an athlete. Thus, an athlete would be able to use a single training bat for training on multiple aspects like sweet-spot hitting, improving swing mechanics, improving hand-eye coordination and the like. Consequently, the proposed disclosure prevents the athletes from buying multiple training bats for multiple applications. Also, the proposed customizable training bat eliminates the need to acquire the same training bats of varying lengths and weights as the athletes outgrow them.

The abovesaid technical advancements and practical applications of the disclosed method and the apparatus may be attributed to the aspect of using a plurality of removable, replaceable or rearrangeable body segments in the training bat. These aspects have been clearly recited in the independent claims of the present disclosure.

The terms "an embodiment", "embodiment", "embodiments", "the embodiment", "the embodiments", "one or more embodiments", "some embodiments", and "one embodiment" mean "one or more (but not all) embodiments of the invention(s)" unless expressly specified otherwise.

The terms "including", "comprising", "having" and variations thereof mean "including but not limited to", unless expressly specified otherwise.

The enumerated listing of items does not imply that any or all the items are mutually exclusive, unless expressly specified otherwise. The terms "a", "an" and "the" mean "one or more", unless expressly specified otherwise.

While various aspects and embodiments have been disclosed herein, other aspects and embodiments will be apparent to those skilled in the art. The various aspects and embodiments disclosed herein are for purposes of illustration and are not intended to be limiting, with the true spirit being indicated by the following claims.

LIST OF REFERENCE NUMBERS

| Reference number | Label |
|---|---|
| 1 | Training bat |
| 2 | Handle |
| 2a | Wooden handle |
| 2b | Tapered wooden handle |
| 2c | Tapered metal/composite handle |
| 3 | Support rod |
| 4 | Body segment(s) |
| 5 | Endcap |
| 6 | Casing |
| 7 | Threaded intrusions |
| 8 | Guided extrusion(s) |
| 8a | Threaded extrusion |
| 8b | Dowel pins |
| 9 | Rubberized pads |
| 10 | Endcap intrusion |
| 11 | Locking provision |
| 12 | Threaded insert |
| 13 | Knob |
| 14 | Pin holes |
| 15 | Hollow section |
| 16 | Groove |
| 17 | Inside threaded region of the handle |
| 18 | Outside threaded region of the handle |
| 19 | Threaded region of support rod |
| 20 | Proximal end of support rod |
| 21 | Distal end of support rod |
| 22 | Proximal end of handle |
| 23 | Distal end of handle |
| 24 | Proximal end of casing |
| 25 | Distal end of casing |
| 26 | Barrel |

What is claimed is:

1. A customizable training bat comprising:

a) a proximal end and a distal end of said customizable training bat;

b) a plurality of body segments extending from said proximal end and said distal end of said customizable training bat;

c) an extendable support rod having a proximal end and a distal end, wherein said extendable support rod is passed through each of said plurality of body segments;

d) a handle having an opening accommodating said extendable support rod, wherein the length of said customizable training bat is changed by adjusting the length of said extendable support rod by extending outward from said distal end of said handle; and e) a removably connected endcap, wherein relative placement of said body segments provide a variable swing weight.

2. The customizable training bat of claim 1, wherein said plurality of body segments are interchangeably adjoined.

3. The customizable training bat of claim 1, further comprising a thickness profile of the training bat and a barrel profile of the training bat, wherein said thickness profile is changed by changing the thickness of said plurality of body segments.

4. The customizable training bat of claim 1, further comprising an interlocking mechanism to adjoin said plurality of body segments.

5. The customizable training bat of claim 4, wherein said interlocking mechanism is an extrusion on said plurality of body segments that is guided into the intrusion of the adjacent body segment for adjoining said plurality of body segments.

6. The customizable training bat of claim 4, wherein said interlocking mechanism comprises threading on the inside of a hollow intrusion and threading on the outside of a guided extrusion thereby allowing said plurality of body segments to adjoin by a screw mechanism.

7. The customizable training bat of claim 4, wherein said interlocking mechanism comprises at least one dowel pin designed on an adjacent surface of each of the plurality of body segments and at least one hole for receiving said dowel pin on said adjacent surface.

8. The customizable training bat of claim 4, wherein said interlocking mechanism comprises placing at least one adhesive rubberized pad between each of said plurality of body segments.

9. The customizable training bat of claim 1, wherein said proximal end of the extendable support rod comprises a threaded surface for connecting said extendable support rod to said handle through a threaded opening of said handle.

10. The customizable training bat of claim 1, wherein said distal end of said extendable support rod comprises a latching mechanism for locking said endcap to said extendable support rod.

11. The customizable training bat of claim 1, further comprising an optionally weighted removably attached knob.

12. The customizable training bat of claim 1, wherein said plurality of body segments are enclosed within a casing.

13. The customizable training bat of claim 12, wherein the length of the customizable training bat is changed by adjusting the length of said casing that extends outward from the distal end of a said handle.

14. The customizable training bat of claim 1, wherein shape of said plurality of body segments is selected from the group consisting of cylindrical, rectangular, and non-cylindrical shapes.

15. The customizable training bat of claim 1, wherein said body segments have length in the range of 1 inch to 30 inches.

16. The customizable training bat of claim 1, wherein a desired swing weight is obtained by relative placement of body segments of varying weights along the length of said training bat.

17. The customizable training bat of claim 1, wherein said endcap secures said body segments tightly in place between said endcap and said handle.

18. A customizable training bat comprising:

a) a proximal end and a distal end of said customizable training bat;

b) a plurality of body segments extending from said proximal end and said distal end of said customizable training bat by an interlocking mechanism;

c) an extendable support rod having a proximal end and a distal end, wherein said extendable support rod is passed through each of said plurality of body segments;

d) a handle having an opening accommodating said extendable support rod and interlocking mechanism to attach to said body segments, wherein the length of said customizable training bat is changed by adjusting the length of said extendable support rod by extending outward from said distal end of said handle;

e) a removably connected knob; and f) a removably connected endcap, wherein said plurality of body segments are interchangeably adjoined and wherein relative placement of said body segments provide a variable swing weight.

19. A customizable training bat comprising:

a) a proximal end and a distal end of said customizable training bat;

b) a plurality of body segments extending from said proximal end and said distal end of said customizable training bat by an interlocking mechanism;

c) an extendable support rod having a proximal end and a distal end, wherein said extendable support rod is passed through each of said plurality of body segments;

d) a handle having an opening accommodating said extendable support rod and interlocking mechanism to attach to said body segments, wherein the length of said customizable training bat is changed by adjusting the length of said extendable support rod by extending outward from said distal end of said handle;

e) a removably connected knob;

f) a casing that houses said body segments; and g) a removably connected endcap, wherein said plurality of body segments are interchangeably adjoined and wherein relative placement of said body segments provide a variable swing weight.

* * * * *